US011139548B2

(12) United States Patent
Wu et al.

(10) Patent No.: US 11,139,548 B2
(45) **Date of Patent: *Oct. 5, 2021**

(54) DUAL-MODE MONOBLOCK DIELECTRIC FILTER AND CONTROL ELEMENTS

(71) Applicant: The Chinese University of Hong Kong, Shatin (CN)

(72) Inventors: Ke-Li Wu, Shatin (CN); Yuliang Chen, Yangzhou (CN); Yan Zhang, Nanjing (CN)

(73) Assignee: The Chinese University of Hong Kong, Shatin (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/943,971

(22) Filed: Jul. 30, 2020

(65) Prior Publication Data

US 2021/0167483 A1 Jun. 3, 2021

Related U.S. Application Data

(63) Continuation-in-part of application No. 16/700,016, filed on Dec. 2, 2019, now Pat. No. 10,950,918.

(51) Int. Cl.

| | |
|---|---|
| ***H01P 1/20*** | (2006.01) |
| ***H01P 7/10*** | (2006.01) |
| ***H01P 1/213*** | (2006.01) |
| *H01P 1/208* | (2006.01) |

(52) U.S. Cl.

CPC ..... *H01P 7/105* (2013.01); *H01P 1/213* (2013.01); *H01P 1/2086* (2013.01)

(58) Field of Classification Search

CPC .... H01P 1/2086; H01P 1/2084; H01P 1/2002; H01P 1/2053; H01P 1/2056; H01P 1/202;

(Continued)

(56) References Cited

U.S. PATENT DOCUMENTS

| | | | |
|---|---|---|---|
| 6,661,310 | B2 | 12/2003 | Okada |
| 9,190,705 | B2 | 11/2015 | Wu et al. |
| 2008/0231391 | A1 | 9/2008 | Takubo et al. |
| 2015/0035626 | A1 | 2/2015 | Tomaki et al. |
| 2016/0099492 | A1 | 4/2016 | Yuan et al. |

FOREIGN PATENT DOCUMENTS

| | | | |
|---|---|---|---|
| WO | 2017/088174 | A1 | 6/2017 |
| WO | 2017/088195 | A1 | 6/2017 |

OTHER PUBLICATIONS

Notice of Allowance from U.S. Appl. No. 16/700,016 dated Dec. 11, 2020, 11 pages.

(Continued)

*Primary Examiner* — Stephen E. Jones
(74) *Attorney, Agent, or Firm* — Kilpatrick Townsend & Stockton LLP

(57) ABSTRACT

A dual-mode dielectric resonator using two dissimilar modes is described, the dissimilar modes supported by a ridge waveguide resonator and a ¼-wavelength (¼λ) metalized cylindrical resonator within a single, metal-coated dielectric block. Each ridge waveguide resonator and cylindrical resonator form a dual-mode resonator pair. Coupling control posts set between the ridge waveguide resonator and cylindrical resonator can adjust their coupling. Multiple pairs of ridge waveguide/cylindrical resonators are fabricated in the same dielectric block to form a coupled resonator bandpass filter, including an 8-pole or 10-pole dielectric resonator filter, for 5G or other applications. Transmission zeros can be introduced by a metalized blind hole extending vertically between two ridge waveguide resonators or a microstrip extending between two dual-mode resonator pairs between which there exists no partial-width or full-width dielectric window.

24 Claims, 16 Drawing Sheets

(58) Field of Classification Search
CPC .... H01P 1/201; H01P 1/20; H01P 7/10; H01P 7/105
USPC .... 333/212, 202, 208, 209, 219, 219.1, 222, 333/223, 206, 207, 227, 230
See application file for complete search history.

(56) References Cited

OTHER PUBLICATIONS

Kojima, et al. "A Compact 28GHz Bandpass Filter using Quartz Folded Waveguide." In 2018 IEEE/MTT-S International Microwave Symposium—IMS, pp. 1110-1113. IEEE, 2018.
Matsutani, et al. "Miniaturized Quartz Waveguide Filter using Double-Folded Structure," 2019 IEEE/MTT-S International Microwave Symposium, 1201-1204.
Onaka, et al. "28 GHz wideband filter using quartz crystal waveguide for massive MIMO antenna unit." In 2017 IEEE MTT-S International Microwave Symposium (IMS), pp. 1468-1471. IEEE, 2017.
Pelliccia, et al. "Ultra-compact pseudoelliptic waveguide filters using TM dual-mode dielectric resonators." In Asia-Pacific Microwave Conference 2011, pp. 143-146. IEEE, 2011.
Rong, et al. "LTCC wide-band ridge-waveguide bandpass filters." IEEE transactions on microwave theory and techniques 47, No. 9 (1999): 1836-1840.
San Blas, et al. "Novel Solution for the Coaxial Excitation of Inductive Rectangular Waveguide Filters." In 2018 48th European Microwave Conference (EuMC), pp. 89-92. IEEE, 2018.
Rosenberg, et al., "A Novel Band-Reject Element for Pseudoelliptic Bandstop Filters," IEEE Transactions on Microwave Theory and Techniques, vol. 55, pp. 742-746, Apr. 2007.

RESONATOR PAIR

DUAL-MODE MONOBLOCK DIELECTRIC FILTER AND CONTROL ELEMENTS

CROSS-REFERENCES TO RELATED APPLICATIONS

This application is a continuation-in-part (CIP) of U.S. patent application Ser. No. 16/700,016, filed Dec. 2, 2019, the entire contents of which is incorporated by reference in its entirety.

STATEMENT AS TO RIGHTS TO INVENTIONS MADE UNDER FEDERALLY SPONSORED RESEARCH AND DEVELOPMENT

NOT APPLICABLE

BACKGROUND

1. Field of the Invention

The present application generally relates to dielectric resonator filters. Specifically, the application is related to a dual-mode dielectric resonator having a dielectric ridge waveguide resonator and a metalized one quarter-wavelength (¼λ) in the dielectric long cylindrical resonator.

2. Description of the Related Art

A microwave filter is often an essential component in wireless communication systems. To achieve a low insertion loss using high Q resonators, the metallic cavity filter has been widely used for cellular communication base stations due to its mature fabrication technique and low cost. However, its bulkiness restricts its application in fifth generation (5G) and future wireless system base stations. Those stations involve a Multi-Input Multi-Output (MIMO) array antenna that contains tens or even more than a hundred antenna elements, and each antenna element is cascaded with a high performance microwave filter.

In a MIMO array antenna, due to the restriction on the size and weight of microwave components, filters should be compact and lightweight. Therefore, researchers are looking for a compromise between high Q and compact volumes.

FIG. 1 is redrawn to more clearly show technical features from San Blas, A. A., et al. "Novel Solution for the Coaxial Excitation of Inductive Rectangular Waveguide Filters," 2018 48th *European Microwave Conference* (*EuMC*), FIG. 2, 2018. The figure shows a hollow metallic cavity filter employing a mixed mode resonator. The metallic cavity filter consists of a three-quarter-wavelength (¾λ) in air long coaxial resonator and a rectangular waveguide resonator for feeding an air-filled metal waveguide filter. In this configuration, the three-quarter-wavelength (in air) long coaxial resonator is short circuited at one end and open circuited on the other. The metal cylindrical post of the coaxial resonator is inserted horizontally in a rectangular waveguide resonator. The coaxial resonator supports a transverse electromagnetic (TEM) mode, and the waveguide resonator supports a transverse electric (TE) 101 mode, or $TE_{101}$ mode. The two dissimilar modes are coupled through a tuning screw inserted from the top metallic lid, forming a dual mode resonator. The dual-mode resonator serves as an input/output (I/O) resonator, while the rectangular waveguide resonators are conventional single mode resonators.

Wavelengths of electromagnetic waves are shorter in a dielectric material than in air or in a vacuum. A wavelength in a dielectric material is shortened by the square root of relative permittivity times, i.e., $\lambda_d=\lambda_0/\sqrt{\varepsilon_r}$, where $\lambda_0$ is the wavelength in air, $\lambda_d$ is the wavelength in dielectric materials, and $\varepsilon_r$ is the relative permittivity of the dielectric material.

Filters that employ solid dielectrics can be smaller than their air cavity counterparts. A "wavelength" or "operating wavelength" in a dielectric device thus refers to the wavelength in the dielectric, not in the air or a vacuum.

FIG. 2 was drawn by reverse engineering a physical, commercial filter. The design embodies a single mode dielectric ridge waveguide resonator found in references i)

International Patent Publication No. WO 2017/088195 A1 to Qiu et al., titled "Dielectric Resonator and Filter," ii) International Patent Publication No. WO 2017/088174 A1 to Zhang et al., titled "Dielectric Filter, Transceiver and Base Station," and iii) U.S. Pat. No. 9,998,163 to Yuan, titled "Filter and Transceiver Comprising Dielectric Body Resonators Having Frequency Adjusting Holes and Negative Coupling Holes." There are a multitude of ridge waveguide resonators formed in the top with dielectric windows between. Each of the ridge waveguide resonators supports a $TE_{101}$ like mode. Using dielectric ridge waveguide resonators for a bandpass filter has been reported by Rong et al. in "Low-temperature cofired ceramic (LTCC) ridge waveguide bandpass chip filters" (IEEE Trans. on Microwave Theory and Techniques, 1999).

The Qiu reference discloses a single mode dielectric resonator comprising a main body and a surrounding wall, which is arranged on a surface of the main body in a protruding manner. The dielectric resonator improves the energy leakage problem between open circuit faces and pushes the harmonic wave far away from passband.

The Zhang and Yuan references disclose dielectric resonators with adjusting holes located on their body, each adjusting hole forming a resonant cavity together with the portion of the body around the adjusting hole. Moreover, a blind hole is introduced between every two resonant cavities that are not adjacent to each other.

The Rong reference teaches that forming dielectric ridge waveguide resonators in an dielectric block can reduce the size of a bandpass filter.

While each of the disclosed devices above have their strengths, there is a need in the art for more compact resonators.

BRIEF SUMMARY

Generally described is a dielectric resonator block on which is formed a dielectric ridge waveguide depression and in which is formed a metalized quarter-wavelength (¼λ) long cylindrical resonator. The dielectric ridge waveguide depression is a 90° straight-down, cylindrical or prismatic depression, geometrically akin to a "right circular cylinder" or "right prism."

In operation, the ridge waveguide resonator is dominated by the transverse electric ($TE_{101}$) like mode or transverse electromagnetic (TEM) mode, depending on the depth of the ridge with respect to operating wavelength. For convenience, the mode supported by the ridge waveguide resonator is referred to as the "$TE_{101}$ like mode" herein.

The cylindrical resonator is shaped like a cylinder on its side and has its circular inside surfaces coated with a metal. In quarter-wavelength (¼λ) resonator configurations, the horizontal cylinder has one end electrically connected to a thin metal coating that covers the outside of the dielectric resonator block and the other end is free from connecting to any metal surface and is electrically open circuited. In operation, the horizontal cylindrical resonator supports the transverse electromagnetic (TEM) mode.

The relative position of the ridge waveguide resonator and the horizontal cylindrical resonator affects coupling between the resonators. Together, the ridge waveguide resonator and the cylindrical resonator form a "dual-mode resonator pair."

Multiple dielectric dual-mode resonator pairs can be formed in the same physical block of dielectric with partial windows formed between them. For example, 4 resonator pairs can form an 8-pole dielectric resonator filter. Each pair can couple $TE_{101}$ like and/or TEM modes to the same type of mode in an adjacent pair. Non-paired single mode ridge waveguide resonators can be coupled to the dual-mode resonators, for example in a 10-pole dielectric resonator filter, four pairs of the dual-mode resonators and two single mode ridge waveguide resonators can be legitimately coupled to form a 10-pole filter with a pair of transmission zeros on each side of the passband.

Some embodiments of the present invention are related to a dielectric resonator filter apparatus comprising a dielectric block having a top and sides, a right cylindrical depression in the top of the dielectric block, a horizontal cylindrical cavity within the dielectric block, the horizontal cylindrical cavity having an axis that is parallel with the top of the dielectric block, a conductive layer covering the dielectric block, the right cylindrical depression, and the horizontal cylindrical cavity. The right cylindrical depression is a ridge waveguide resonator that, in operation, is dominated by a transverse electric ($TE_{101}$) like mode, and the horizontal cylindrical cavity is configured to support a transverse electromagnetic (TEM) mode of electromagnetic waves within operating wavelengths of the dielectric resonator filter apparatus. One or more right cylindrical posts can be inserted between the two resonators to change electromagnetic coupling between the $TE_{101}$ like and TEM modes.

A length of the horizontal cylinder can be about one quarter (¼λ) of the operating wavelengths in the nominal pass band, which is physically allowed in the dielectric block. Other configurations can use half wavelength (½λ) long horizontal cylindrical resonators.

The apparatus can include one or more coupling control posts extending between the right cylindrical depression and the horizontal cylindrical cavity from the top or a bottom of the dielectric block, the post including a blind hole with metalized surfaces or a solid metal cylinder.

The apparatus can include an opening from an outside of the dielectric block to the horizontal cylindrical cavity. The horizontal cylindrical cavity can extend to one of the sides of the dielectric block and form the opening, or it can be buried inside. An annular, insulative gap can exist between the conductive layer and a second conductive layer inside the horizontal cylindrical cavity for certain configurations, including half wavelength (½λ) configurations.

The apparatus can include a coaxial feeding probe extending from the bottom of the dielectric block close to the right cylindrical depression. An annular insulative gap can exist between the conductive layer and the feeding probe. This annular insulative gap is introduced to prevent the input/output feeding probe from being short-circuited with the metalized outer surface of the dielectric block.

The right cylindrical depression and the horizontal cylindrical cavity can constitute a first dual-mode resonator pair, the right cylindrical depression being a first right cylindrical depression, and the horizontal cylindrical cavity being a first horizontal cylindrical cavity, and the apparatus can further include a second dual-mode resonator pair in the dielectric block comprising a second right cylindrical depression in the top of the dielectric block and a second horizontal cylindrical cavity within the dielectric block, and a partial-width dielectric window between the first and second dual-mode resonator pairs, the partial-width dielectric window formed by a conductive, vertical channel in one or more of the sides of the dielectric block.

Axes of the first and second cylindrical cavities can be parallel, and the first and second cylindrical cavities can extend from a common side of the dielectric block. The first or second right cylindrical depression can be between the first and second cylindrical cavities. Axes of the first and second cylindrical cavities can be parallel, and the first and second cylindrical cavities can extend from opposite sides of the dielectric block. Axes of the first and second cylindrical cavities can be perpendicular to one another. The first and second cylindrical cavities can share a common axis, the first and second cylindrical cavities can extend from opposite sides of the dielectric block. The conductive, vertical channel can bisect the common axis between the first and second cylindrical cavities.

The apparatus can include a third dual-mode resonator pair in the dielectric block comprising a third right cylindrical depression and a third horizontal cylindrical cavity, a fourth dual-mode resonator pair in the dielectric block comprising a fourth right cylindrical depression and a fourth horizontal cylindrical cavity, and partial-width dielectric windows between multiple of the resonator pairs, each partial-width dielectric window formed or otherwise defined by a conductive, vertical channel in one or more of the sides of the dielectric block, wherein axes of the first and second cylindrical cavities are perpendicular, axes of the second and third cylindrical cavities are parallel, and axes of the third and fourth cylindrical cavities are perpendicular, whereby the first, second, third, and fourth dual-mode resonator pairs form an 8-pole dielectric resonator filter.

The apparatus can further include a first feeding probe vertically extending from the bottom of the dielectric block directly underneath and/or near a cylindrical depression and a second feeding probe vertically extending from the bottom of the dielectric block directly underneath and/or near another cylindrical depression.

The apparatus can further include a third dual-mode resonator pair in the dielectric block comprising a third right cylindrical depression and a third horizontal cylindrical cavity, a fourth dual-mode resonator pair in the dielectric block comprising a fourth right cylindrical depression and a fourth horizontal cylindrical cavity, a fifth right cylindrical depression in the dielectric block, a sixth right cylindrical depression in the dielectric block, partial-width dielectric windows between multiple of the resonator pairs, each partial-width dielectric window formed by a conductive, vertical channel in one or more of the sides of the dielectric block, partial-width dielectric windows between a dual-mode resonator and the fifth or sixth right cylindrical depressions, and a metalized blind hole extending vertically from the top surface between the fifth and sixth right cylindrical depressions, wherein axes of the first, second, third, and fourth cylindrical cavities are parallel, whereby the first, second, third, and fourth dual-mode resonator pairs and fifth and sixth right cylindrical depressions form a 10-pole dielectric resonator filter.

The apparatus can further include one or more coupling control posts extending between the right cylindrical depression and the horizontal cylindrical cavity of at least one of the first, second, third, or fourth dual-mode resonator pairs from the top or the bottom of the dielectric block, the post including a blind hole with metalized surfaces or a solid metal cylinder.

The apparatus can further include a metalized blind hole extending vertically from the top surface between the fifth and sixth right cylindrical depressions for creating an opposite coupling as compared to that created by the partial-width dielectric window. Such coupling is sometimes called "negative coupling."

The apparatus can further include a third dual-mode resonator pair in the dielectric block comprising a third right cylindrical depression and a third horizontal cylindrical cavity, a fourth dual-mode resonator pair in the dielectric block comprising a fourth right cylindrical depression and a fourth horizontal cylindrical cavity, partial-width dielectric windows between multiple of the dual-mode resonator pairs, each partial-width dielectric window formed by a conductive, vertical channel in one or more of the sides of the dielectric block, and a conductive strip extending between two dual-mode resonator pairs between which there exists no partial-width or full-width dielectric window.

The right cylindrical depression can have a cross section of a circle, rectangle, or square, among other closed shapes. The cross section can be rectangular or square, which normally have sharp corners, yet have filleted or chamfered corners. The dielectric block can be rectangular. The dielectric block can include a material selected from the group consisting of ceramic, glass, or a polymer.

A transceiver can comprise the dielectric resonator filter apparatus described above, and a base station can comprise the transceiver.

DETAILED DESCRIPTION

Figure 1:
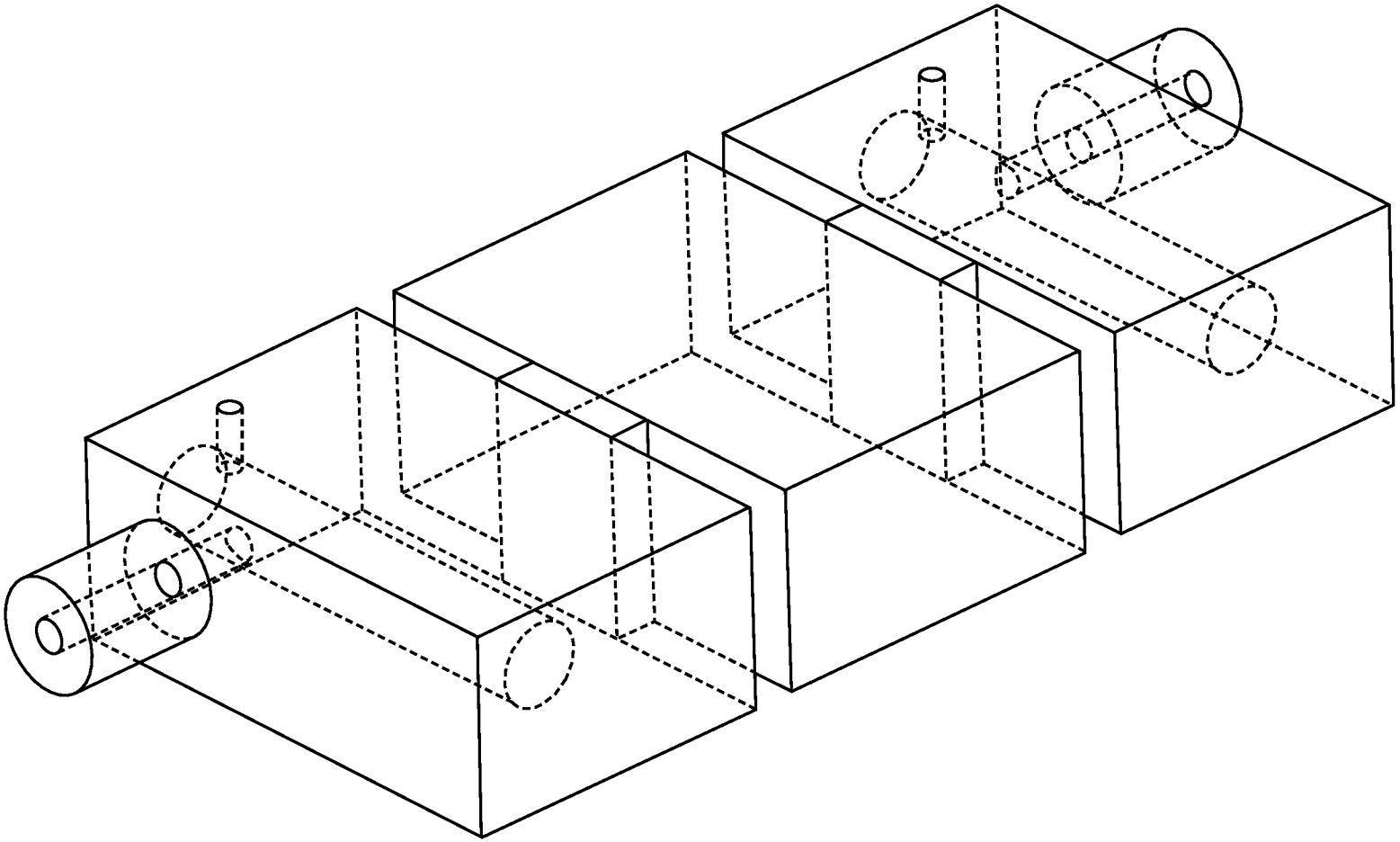
FIG. 1 (PRIOR ART)
FIG. 1 is an isometric view of a hollow metallic cavity filter of the prior art.
Figure 2:
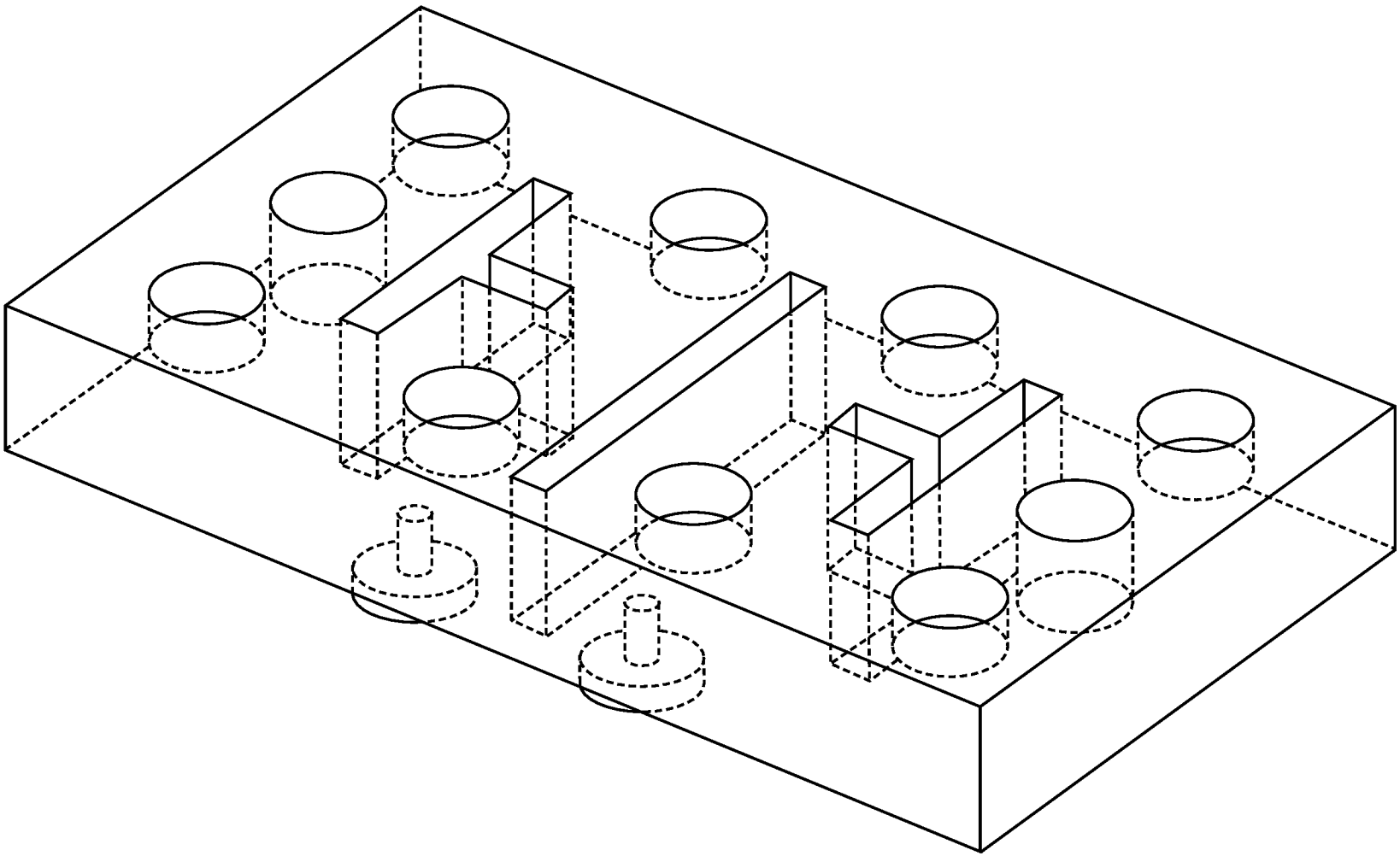
FIG. 2 (PRIOR ART)
FIG. 2 is an isometric view of a dielectric resonator filter with dielectric ridge waveguide resonators of the prior art.

Disclosed herein is an advanced miniaturization technology and design method for microwave dielectric filters in wireless communication base station equipment, particularly for the systems where Multi-Input Multi-Output (MIMO) and Massive-MIMO (M-MIMO) array antennas are used.

A dual-mode dielectric resonator is described that has potential for applications in fifth generation (5G) and future wireless communication base stations, where massive MIMO array antennas are used and compact microwave filters are highly desirable.

Using degenerate modes in the same resonator can support more than one electrical resonator in the same volume. Degenerate modes are modes that possess the same resonant frequency but orthogonal mode field patterns. Such a resonator shared by two degenerate modes is called "dual-mode resonator."

A resonator that is shared by two non-degenerate modes but with the same resonant frequency but dissimilar mode field patterns can also be called "dual-mode resonator." In recent years, various filter technologies employing dielectrics and/or degenerate modes have been employed for size reduction. Some embodiments described herein take that to the next level, as can be appreciated from the following descriptions.

A smallest building block of the dual-mode dielectric resonator comprises a dielectric ridge waveguide resonator and a metalized quarter-wavelength ($\frac{1}{4}\lambda$) long cylindrical resonator. The dielectric dual-mode resonator supports two dissimilar resonant modes at the same frequency. Both modes are fundamental modes of the physical resonators. As a result, the quarter-wavelength long cylindrical resonator shares the same physical volume as the ridge waveguide resonator. This can lead to a 50% space reduction as compared to the single mode resonator filters of the prior art.

Instead of a three-quarter-wavelength (¾λ) long coaxial TEM mode resonator as in the prior art, a quarter-wavelength (¼λ) long coaxial TEM mode resonator is used. To support a quarter-wavelength long resonator, one end of the resonator should be short-circuited and the other end should be open-circuited. A quarter-wavelength long length almost perfectly fits within the volume of a dielectric ridge waveguide resonator.

One of the most challenging matters in coordinating the ridge waveguide resonator with the cylindrical resonator in the same volume is how to reduce the inevitable coupling between the two resonators. The coupling is inevitable because the two dissimilar modes are not totally orthogonal. Controllable coupling between the quarter-wavelength long resonator to the ridge waveguide resonator using a "coupling control post" is proposed herein.

A dielectric ridge waveguide resonator is used instead of a rectangular waveguide resonator of the prior art. With the loaded ridge, the coupling between the $TE_{101}$ like resonant mode of the ridge waveguide resonator and the TEM mode of the coaxial cylindrical resonator can be more easily controlled with one or more partial-height vertically introduced metalized coupling control posts between the two resonators.

Unlike the disclosed application in San Blas et al., in which the TEM mode resonators are only used as the input/output (I/O) structure to excite the waveguide resonator mode, and the other waveguide resonators are still single-mode resonators, most all the physical resonators can be dual-mode resonators in the present embodiments.

Various possible coupling arrangements for the same type of resonant modes and dissimilar types of modes are described herein. With an appropriate assembly of the proposed dual-mode dielectric resonators, and accurate control of the couplings between the dielectric resonators, both symmetric and asymmetric filtering responses can be realized.

Technical advantages of the proposed dual-mode dielectric filter assembly embodiments are manifold. They employ a dual-mode resonator that supports two dissimilar fundamental modes: a quarter-wavelength (¼λ) TEM mode, and a ridge waveguide cavity mode. Because both of the modes are fundamental modes, inherently, the filter using the dual-mode resonators can have up to 50% of volume reduction as compared to prior art filters commonly in use for MIMO array antennas of 5G base stations while providing a wide spurious free rejection band. In this application, layouts of dual-mode resonators for constructing a high order filter are described. Some layouts allow relatively independent tuning of each variable, facilitating mass production of the filter. To improve the rejection rate near the pass band, transmission zeros can be flexibly introduced by using the preferred filter configuration, enabling the realization of both symmetric and asymmetric filtering responses.

According to some embodiments, a novel dual-mode dielectric resonator is presented that includes a dielectric cavity coated with a conductive layer on the surface. A chamfered square ridge or circular cylindrical ridge is formed along the vertical direction on the top surface of the cavity. A metal cylinder is buried along horizontal direction along a side surface of the cavity. The metal cylinder is about a quarter of a wavelength (¼λ) long in terms of the center frequency of the filter in the dielectric cavity. One end is free from any electric contact to the conductive walls of the cavity, and its other end is connected to an outer side wall of the dielectric block coated with a conductive layer on the surface. The diameter of the metal cylinder is electrically small, for example less than 0.1 wavelength. The dielectric ridge resonator supports a $TE_{101}$ like mode, whereas the metal cylinder supports a TEM mode. The pairing form a dual-mode resonator, and each component of which forms an electric resonant circuit. The coupling of the two modes can be controlled by one or more partial-height vertically introduced metalized coupling control posts between the two resonators.

According to some embodiments, a dielectric filter can include a plurality of dielectric dual-mode resonators with a common conductive layer on the surface. A separating iris can be provided between each of two adjacent dielectric dual-mode resonator cavities. Each of the dielectric dual-mode resonators can include a separated dielectric cavity with the conductive layer on the surface, a cylindrical ridge inserted along the vertical direction from the top surface of the cavity, and a one-end-open and one-end-short-circuited metal cylinder buried along the horizontal direction of a side surface of the cavity. In operation, each of the dielectric dual-mode resonators can support a TEM mode and a $TE_{101}$ like mode, each of which forms an electric resonant circuit.

According to other embodiments, a method of designing and manufacturing a dielectric filter are provided. The method includes obtaining dimension parameters of the dielectric cavity, ridge and metal cylinder of each resonator, coupling control post, as well as the dimensions of the coupling irises, the spacing of the ridge and the metal cylinder for the filter based on required center frequency, bandwidth, return loss, designated transmission zeros, and designing an appropriate layout arrangement of the dielectric cavity with minimum unwanted parasitic coupling.

It will be apparent to those skilled in the art that regarding the specification and practice of the present disclosure that various modifications and variations can be made to the disclosed assemblies and methods without departing from the scope of the disclosure. For example, forming a quarter of a wavelength long metalized cylindrical hole, whose end inside the dielectric cavity is open and its other end is connected to a side wall of the cavity can be made by drilling a hole on the monoblock dielectric body and silver plating the surface. It is intended that the specification and examples be considered as exemplary only, with a true scope of the present disclosure being indicated by the claims and their equivalents.

Figure 3:
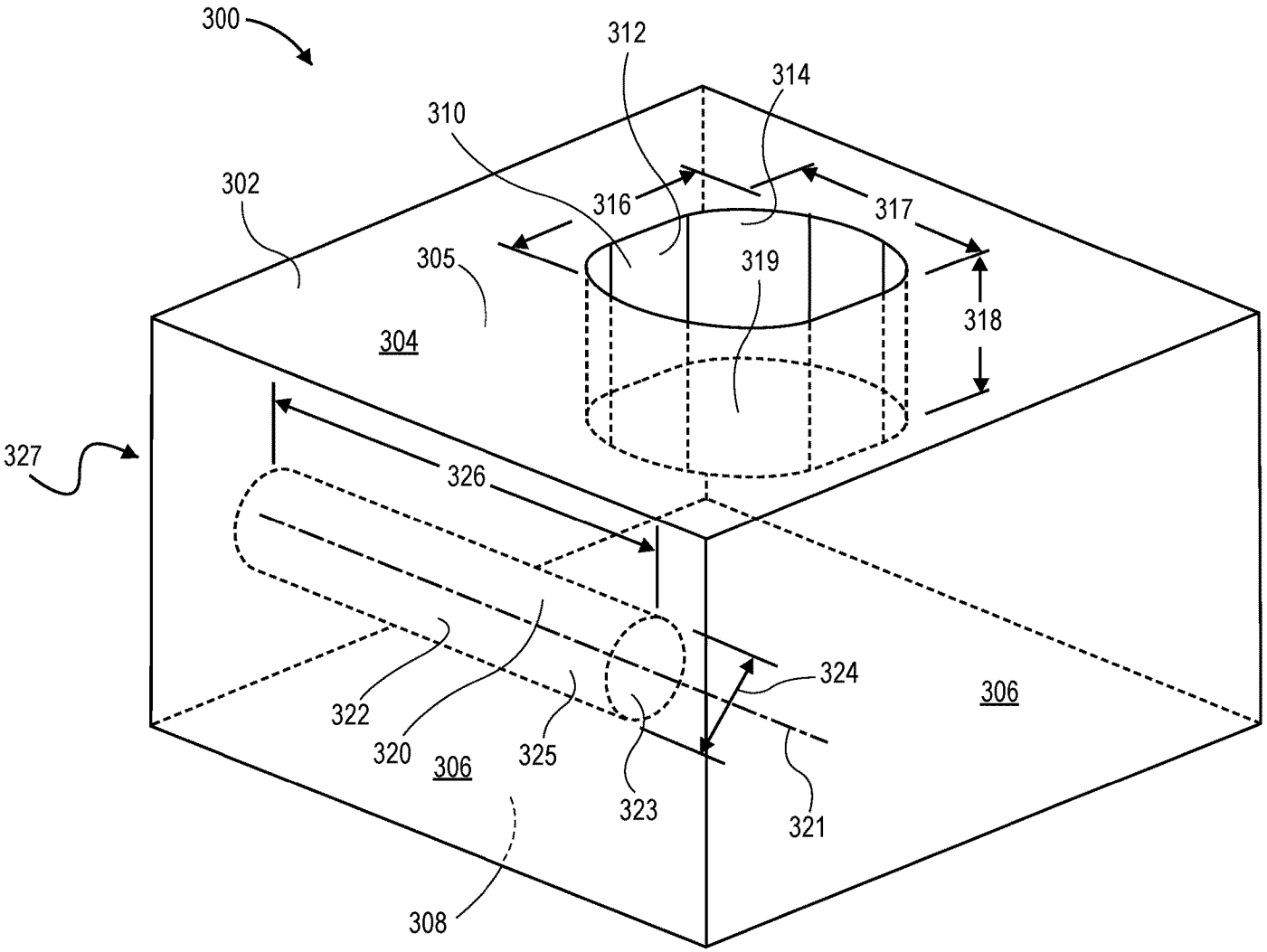
FIG. 3 is an isometric view of a dual-mode resonator pair, including a dielectric resonator with a dielectric ridge waveguide resonator and a cylindrical resonator, in accordance with an embodiment.

FIG. 3 is an isometric view of a dual-mode resonator pair, which is sometimes referred to as the smallest conceptual building block of later assemblies. Assembly 300 include rectangular-cubic dielectric block 302 having top 304, four sides 306, and bottom 308.

Within dielectric block 302 is right cylindrical depression 310, also called a "ridge" or "ridge waveguide resonator." Being shaped like a right cylinder, ridge waveguide resonator 310 has 90-degree sides 312 and flat bottom 319. Flat bottom 319 is parallel with top 304 of the dielectric block. Width 316 and length 317 of the sides of the ridge waveguide resonator are not necessarily equal in the exemplary embodiment. Depression 310 descends to depth 318.

A cross-section of depression 310 is largely square (with filleted corners), but it may also be rectangular, circular, or other closed shapes.

Radiused fillets 314 or chamfers on the four inside corners of the depression proof the dielectric block from cracking. Further, the radiuses may be artifacts of the manufacturing process and are not typically critical to the electrical design.

Conductive layer 305 covers top 304, sides 306, and bottom 308 of the dielectric block. The conductive layer entirely covers the surfaces within depression 310, including walls 312, fillets 314, and flat bottom 319.

Horizontal cylindrical resonator 320 extends from a back side 306 of the dielectric block and terminates as a blind hole. The cylindrical resonator has solid end 323 at one end and opening 327 to air at the other. It has smooth inner surface 322 around its diameter 324, all of the way to its depth 326 to end 323. Its axis 321 runs parallel with top 304, which is also parallel with bottom 308. In the exemplary embodiment, axis 321 parallels one of the sides 306.

Metalized conductive layer 325 covers the circumference of inside surface 322 but not blind end 323. Metalized conductive layer 325 is connected with the rest of the block's conductive layer 305 at backside 304. This forms a short circuit from the outer surface to the cylindrical walls but not end 323.

Depth 326 of cylindrical resonator is approximately one-quarter of a wavelength (¼λ) of an operating wavelength or frequency of the dual-mode dielectric resonator. The selected frequency can be the center frequency of the filter's pass band. As dimensioned, cylindrical resonator 320 is configured to support TEM modes of electromagnetic waves, typically microwaves. It interacts with ridge waveguide resonator 310, which, in contrast to the cylindrical resonator, is dominated by a $TE_{101}$ like mode of the electromagnetic waves. The dielectric ridge waveguide resonator and the cylindrical resonator form a single dual-mode resonator pair.

During operation, the cylindrical resonator supports a TEM mode, and the ridge loaded dielectric resonator depression supports a $TE_{101}$ like mode, each of which forms a resonant circuit. The coupling between two modes in the same cavity can be adjusted when designing the device by adjusting one or more metalized partial-height coupling control posts vertically inserted between the two resonators.

Figure 4A:
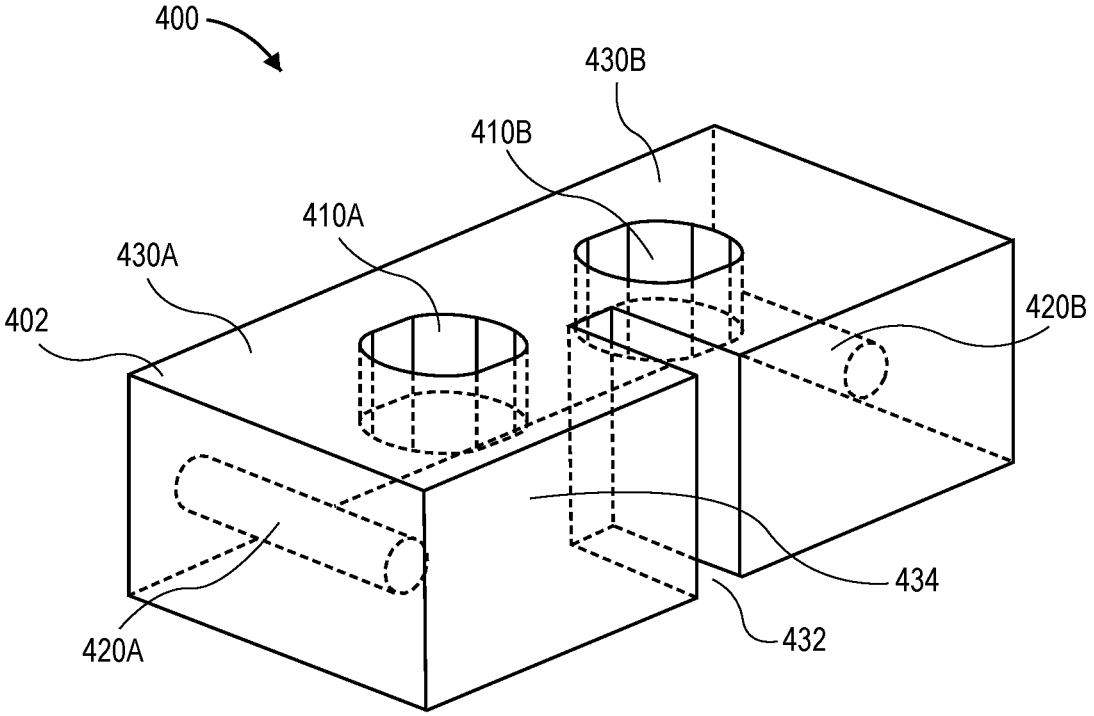
FIG. 4A is an isometric view of two dual-mode resonator pairs separated by a partial-width dielectric window in accordance with an embodiment.
Figure 4B:
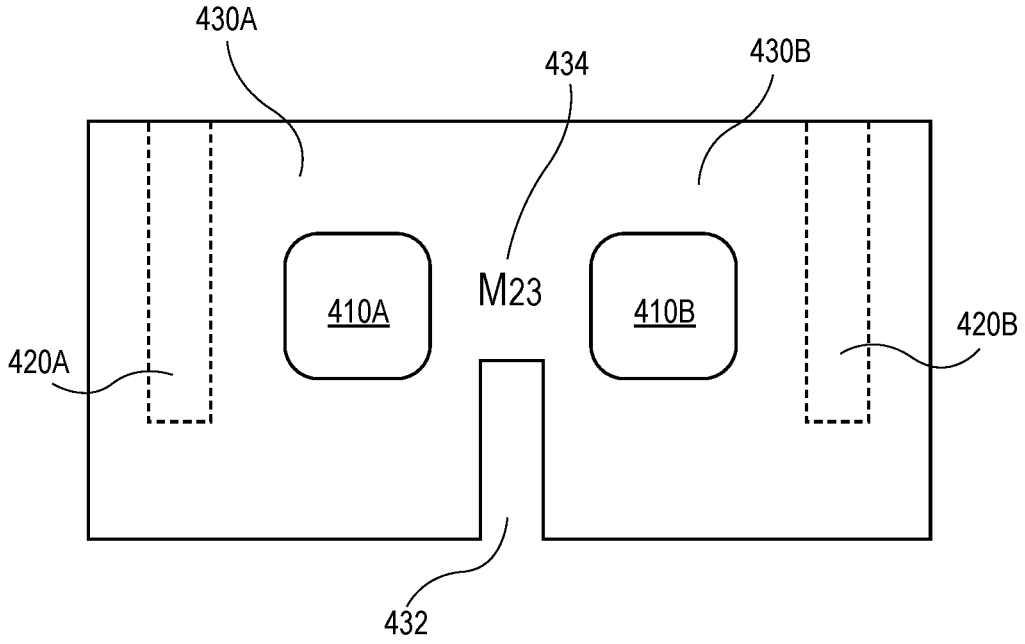
FIG. 4B is top down view of the two dual-mode resonator pairs of FIG. 4A.

FIGS. 4A-4B illustrate two dual-mode resonator pairs separated by a partial-width dielectric window. Assembly 400 includes dielectric block 402 in which is formed a first 'A' resonator pair 430A and a second 'B' resonator pair 430B. Dual-mode resonator pairs 430A and 430B not only share a common, integrated dielectric block, but also share the same outer conductive surface.

First dual-mode resonator pair 430A includes ridge waveguide resonator 410A and horizontal cylindrical resonator 420A. Second dual-mode resonator pair 430B includes ridge waveguide resonator 410B and horizontal cylindrical resonator 420B. Cylindrical resonators 420A and 420B extend from a common side, the back side, of dielectric block 402.

Partial-width dielectric window 434 is formed or otherwise defined between first and second dual-mode resonator pairs 430A and 430B by conductive, vertical channel 432 in a front side of dielectric block 402. Because the sides of the channel are metalized (in addition to the air gap), that portion effectively blocks microwaves from direct transmission therethrough. Note that a line of sight between the blind ends of the cylindrical resonators is blocked by channel 432.

In this filter, the two dual-mode resonator pairs 430A and 430B are arranged with the two ridge waveguide resonators 410A and 410B close to each other. The physical connection between two adjacent resonators is implemented with partial-width window 434. Meanwhile, the cylindrical resonators are parallel but do not substantially couple each other. Thus the $TE_{101}$ like mode in each of the two dual-mode resonators can be coupled, and the coupling between the two TEM modes supported by the metalized cylindrical holes is minimized. During design, the coupling between the two $TE_{101}$ like modes can be adjusted by changing the width and thickness of the partial-width window.

FIGS. 5-8 illustrate different configurations of adjacent resonator pairs. The physical connection between two adjacent dual-mode resonators is controlled by the dimension of a partial-width window between them. The coupling between two adjacent resonators is realized through direct coupling between i) two ridge waveguide resonators or ii) two metalized cylinders. In either coupling arrangement, the metalized cylinders can be arranged in different inserting directions.

Figure 5:
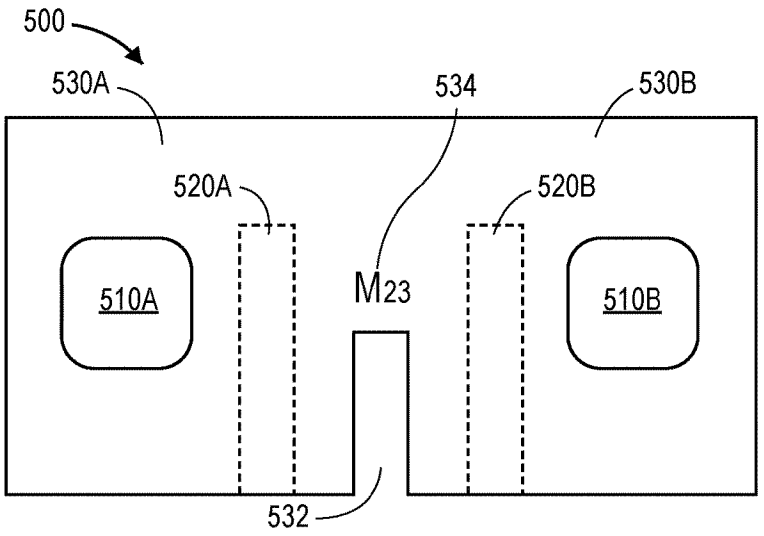
FIG. 5 is a top down view of two dual-mode resonator pairs with parallel cylindrical resonators extending from a common side in accordance with an embodiment.

FIG. 5 illustrates assembly 500 with two dual-mode resonator pairs, 530A and 530B. Cylindrical resonators 520A and 520B extend from a common side, and their axes are parallel. Partial-width dielectric window 534 is formed by channel 532, allowing two TEM modes to couple between cylindrical resonators 520A and 520B, which are close together.

Figure 6:
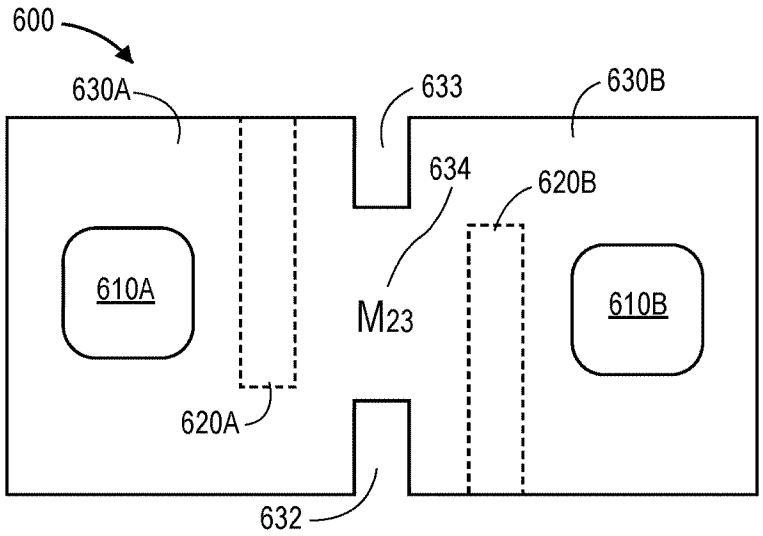
FIG. 6 is a top down view of two dual-mode resonator pairs with parallel cylindrical resonators extending from opposite sides in accordance with an embodiment.

FIG. 6 illustrates assembly 600 with two dual-mode resonator pairs, 630A and 630B. Cylindrical resonators 620A and 620B extend from opposite sides, and their axes are parallel. Partial-width dielectric window 634 is formed by channel 632 on the front side of the dielectric block and channel 633 on the back side. The partial width dielectric window allows two TEM modes to couple between cylindrical resonators 620A and 620B, which are close together.

Figure 7:
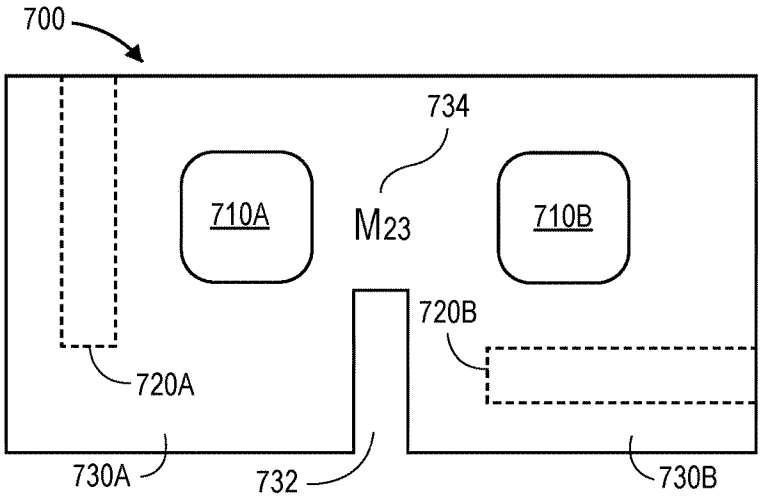
FIG. 7 is a top down view of two dual-mode resonator pairs with perpendicular cylindrical resonators in accordance with an embodiment.

FIG. 7 illustrates assembly 700 with two dual-mode resonator pairs, 730A and 730B. Cylindrical resonators 720A and 720B extend from adjacent and perpendicular sides, and thus their axes are perpendicular. Partial-width dielectric window 734 is formed by channel 732. The partial width dielectric window allows $TE_{101}$ like modes to couple between ridge waveguide resonators 710A and 710B, which are close together. Channel 732 blocks TEM modes from coupling between the cylindrical resonators.

Figure 8:
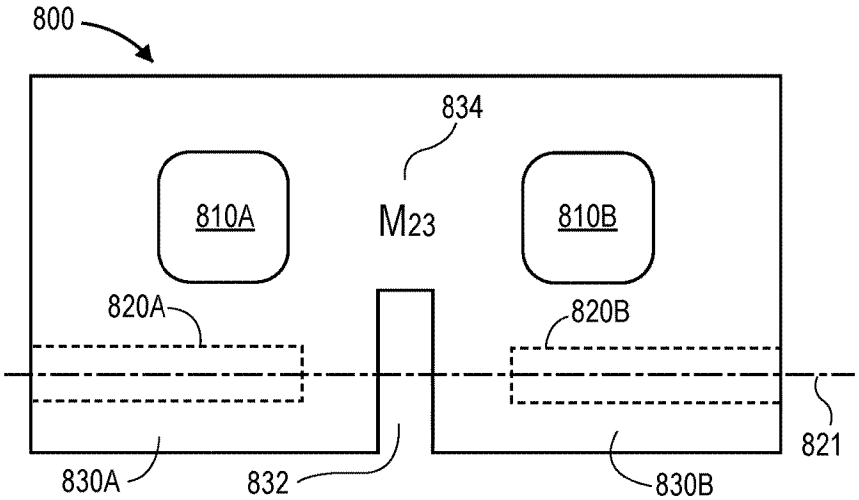
FIG. 8 is a top down view of two dual-mode resonator pairs with cylindrical resonators that share a common axis in accordance with an embodiment.

FIG. 8 illustrates assembly 800 with two dual-mode resonator pairs, 830A and 830B. Cylindrical resonators 820A and 820B extend from opposite sides and share common axis 821. Partial-width dielectric window 834 is formed by channel 832 and allows $TE_{101}$ like modes to couple between ridge waveguide resonators 810A and 810B, which are relatively close together. Channel 832 blocks TEM modes from coupling between the cylindrical resonators.

Figure 9A:
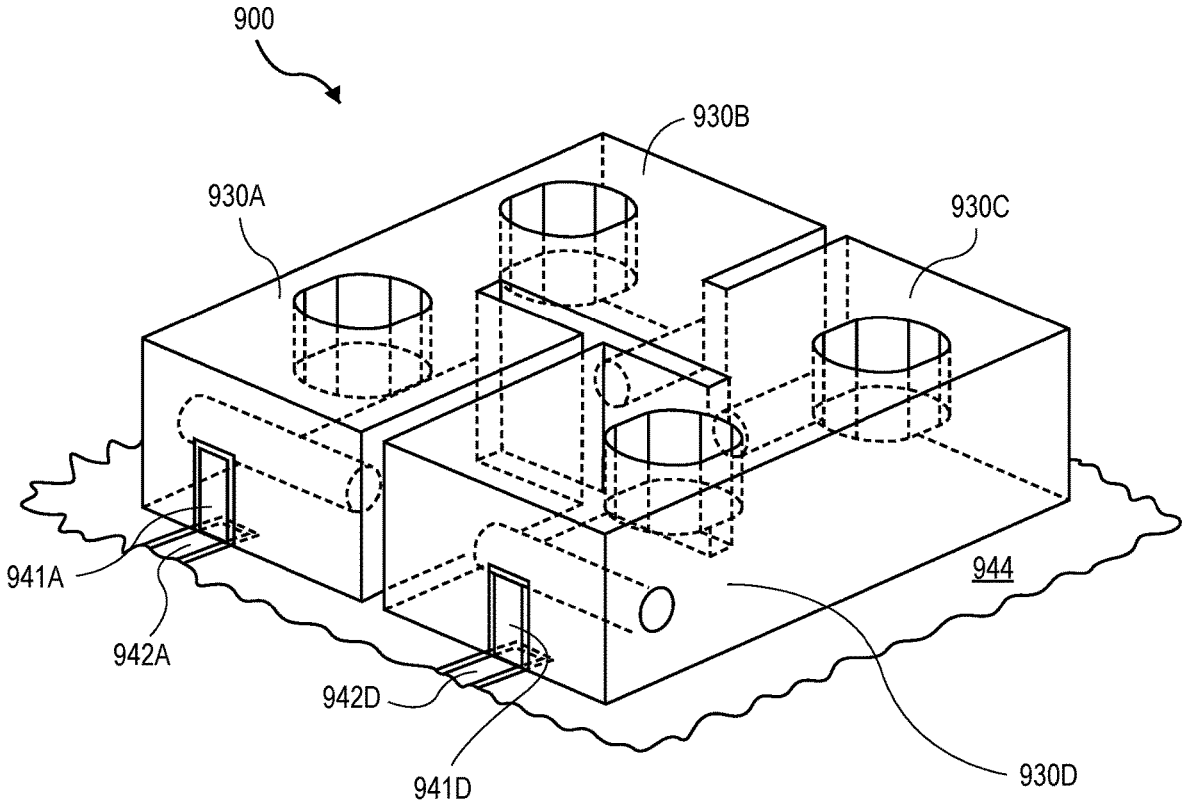
FIG. 9A is an isometric view of an 8-pole filter, comprising four dual-mode resonator pairs, in accordance with an embodiment.
Figure 9B:
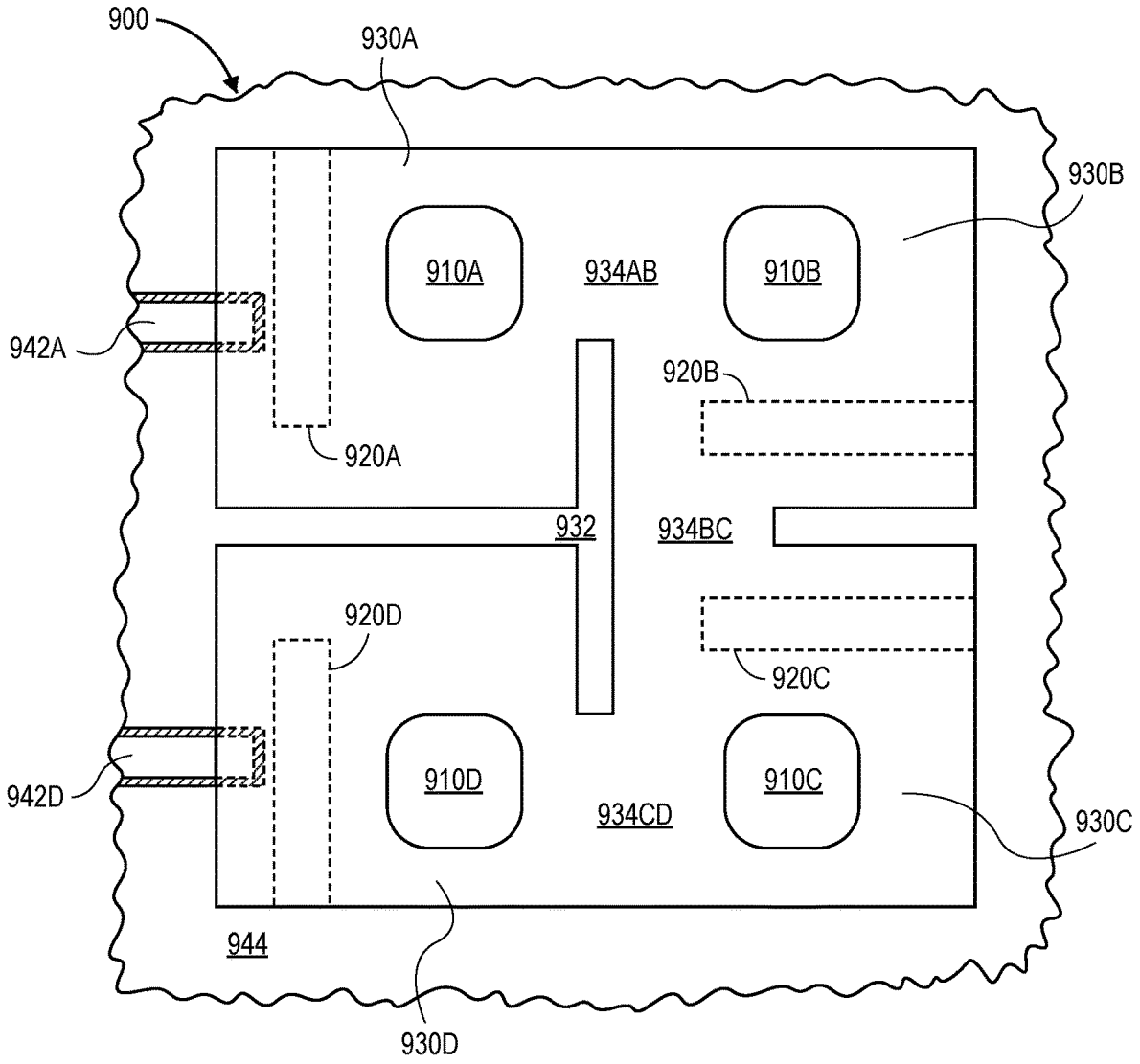
FIG. 9B is a top down view of the 8-pole filter of FIG. 9A.

FIGS. 9A-9B illustrate an 8-pole filter 900 formed by four dual-mode resonator pairs, 930A, 930B, 930C, and 930D.

First dual-mode resonator pair 930A includes ridge waveguide resonator 910A and horizontal cylindrical resonator 920A (see FIG. 9B), and second dual-mode resonator pair 930B includes ridge waveguide resonator 910B and horizontal cylindrical resonator 920B. Third dual-mode resonator pair 930C includes ridge waveguide resonator 910C and horizontal cylindrical resonator 920C, and fourth dual-mode resonator pair 930D includes ridge waveguide resonator 910D and horizontal cylindrical resonator 920D.

Dual-mode resonator pairs 930A and 930B are separated by partial-width dielectric window 934AB. Dual-mode resonator pairs 930B and 930C are separated by partial-width dielectric window 934BC, and dual-mode resonator pairs 930C and 930D are separated by partial-width dielectric window 934CD. T-shaped channel 932 in the dielectric block forms the partial-width windows.

With each building block (see FIG. 3) and the various coupling arrangements between adjacent resonator pairs (see FIGS. 4A-8), larger filters may be properly formed and adjusted. Thus, an 8-pole filter response can be obtained in a compact size as compared to a conventional dielectric waveguide filter. A great many of them can be integrated onto circuit boards or other substrates.

A coplanar waveguide circuit, with traces 942A and 942D, is formed on substrate 944 underneath the filter and can lead to probes. In the figure, traces 942A and 942D are shown to be respectively connected to leads 941A and 941D on the sidewall of the resonator, which may serve for grounding, connections, or other purposes.

Figure 10:
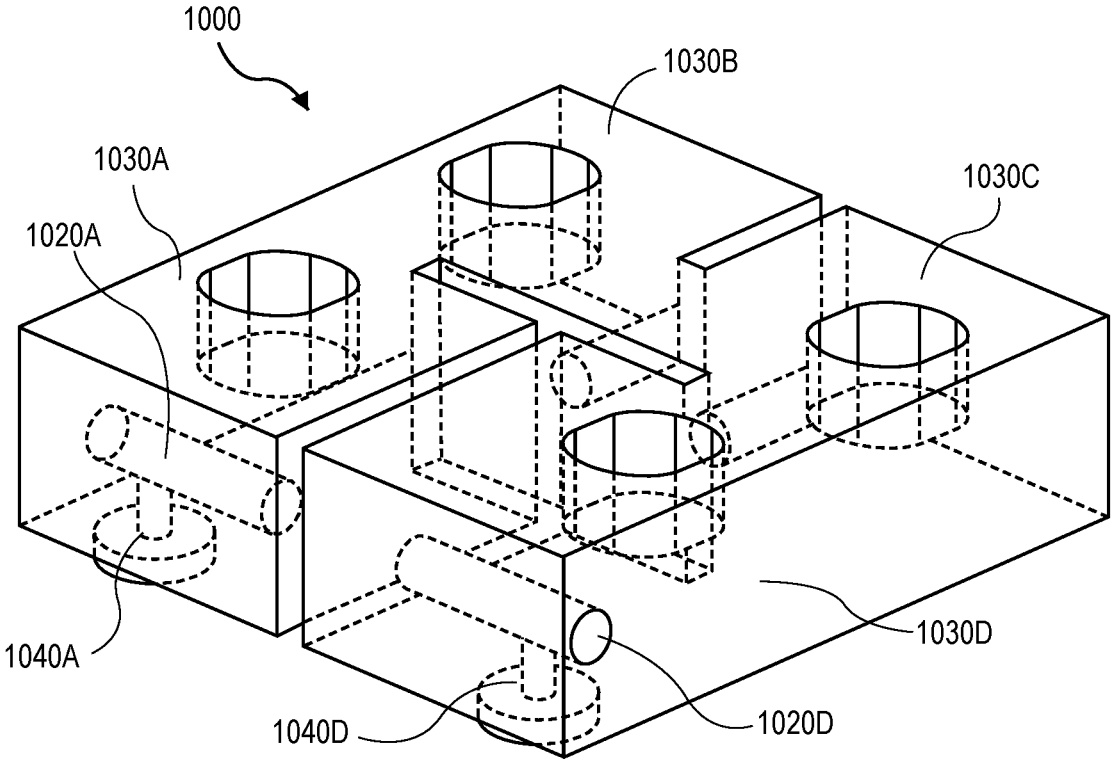
FIG. 10 is an isometric view of an 8-pole filter whose input/output ports are connected with cylindrical resonators in accordance with an embodiment.

FIG. 10 illustrates an 8-pole filter 1000 with ¼ cylinders inserted from the sidewall of the cavity.

The filter is fed by a pair of coaxial feeding probes 1040A and 1040D inserted from the bottom of both terminal resonators 1030A and 1030D. The terminal resonators are connected to each other through a chain resonators, proceeding as follows: 1030A, 1030B, 1030C, and 1030D. The excitation structure can produce cross coupling in each input/output resonator, resulting in transmission zeros in the filter transmission response at either the lower side or the higher side of the passband. The transmission zero can improve the near pass band rejection rate of the filter. The position of the transmission zero is adjustable by adjusting the position of feeding probe 1040A or 1040D along the metal cylindrical resonator 1020A or 1020D to which each probe is attached.

Further embodiments involve other features alone or in combination. The first and the last resonators can be ridge waveguide resonators that are excited by vertical electric input/output probes. A partial height vertical metalized cylinder between a coaxial cylindrical resonator and a ridge waveguide resonator may be used to increase or decrease the coupling between two resonators. And a bandpass filter configuration can combine dual-mode resonators and single mode ridge waveguide resonators. With an appropriate assembly of the dual-mode dielectric resonators and the coupling control scheme between two dissimilar resonators, various filtering responses can be realized in a very compact size.

Figure 12:
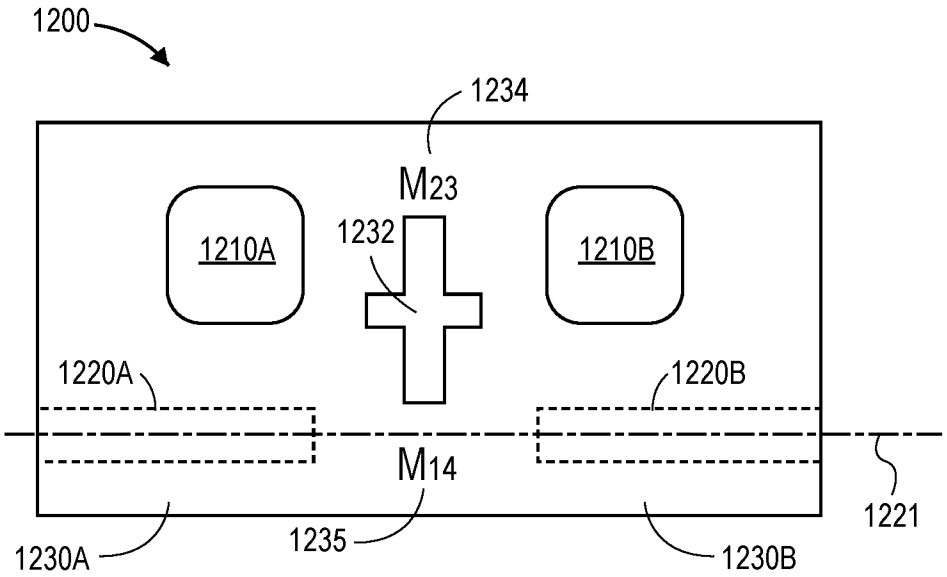
FIG. 12 is a top down view of two dual-mode resonator pairs with cylindrical resonators that share a line-of-sight common axis in accordance with an embodiment.
Figure 11:
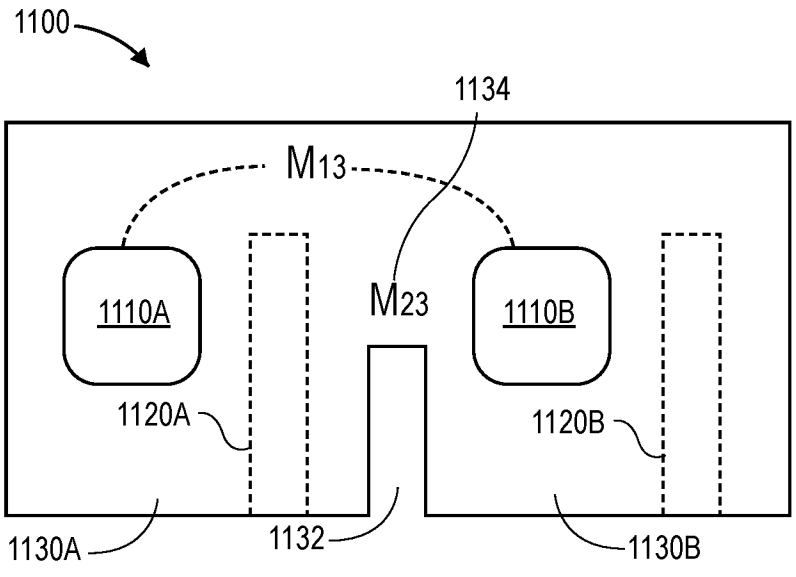
FIG. 11 is a top down view of two dual-mode resonator pairs with parallel cylindrical resonators extending from a common side and with a ridge waveguide between in accordance with an embodiment.

FIGS. 11-12 illustrate still different configurations of adjacent resonator pairs. Like the embodiments shown in FIGS. 5-8, the physical connection between two adjacent dual-mode resonators is controlled by the dimension of a partial-width window between them, and the coupling between two adjacent resonators is realized through direct coupling between i) two ridge waveguide resonators or ii) one metalized cylindrical resonator and a ridge waveguide resonator. All of the configurations, including those of FIGS. 5-8, have ¼λ-long cylinders.

FIG. 11 illustrates assembly 1100 with two dual-mode resonator pairs, 1130A and 1130B. Cylindrical resonators 1120A and 1120B extend from a common side of the dielectric block, and their axes are parallel. Partial-width dielectric window 1134 is formed by channel 1132, allowing $TE_{101}$ like modes to couple between ridge waveguide resonators 1110A and 1110B. Distinct from the embodiment in FIG. 5, there is only one cylindrical resonator, cylindrical resonator 1120A, that is between the ridge waveguide resonators. Cylindrical resonator 1120B is not between them and is instead to the right of ridge waveguide resonator 1110B.

FIG. 12 illustrates assembly 1200 with two dual-mode resonator pairs, 1230A and 1230B. Cylindrical resonators 1220A and 1220B extend from opposite sides of the dielectric block and share a common axis 1221. Partial-width dielectric windows 1234 and 1235 are formed by plus (+) shaped channel 1232, allowing $TE_{101}$ like modes to couple between ridge waveguide resonators 1210A and 1210B, which are relatively close together, and two TEM modes to couple between cylindrical resonators 1220A and 1220B, which face each other. Distinct from the embodiment in FIG. 8, there are two partial-width dielectric windows close by, and neither occludes coupling between the cylindrical resonators.

Figure 13A:
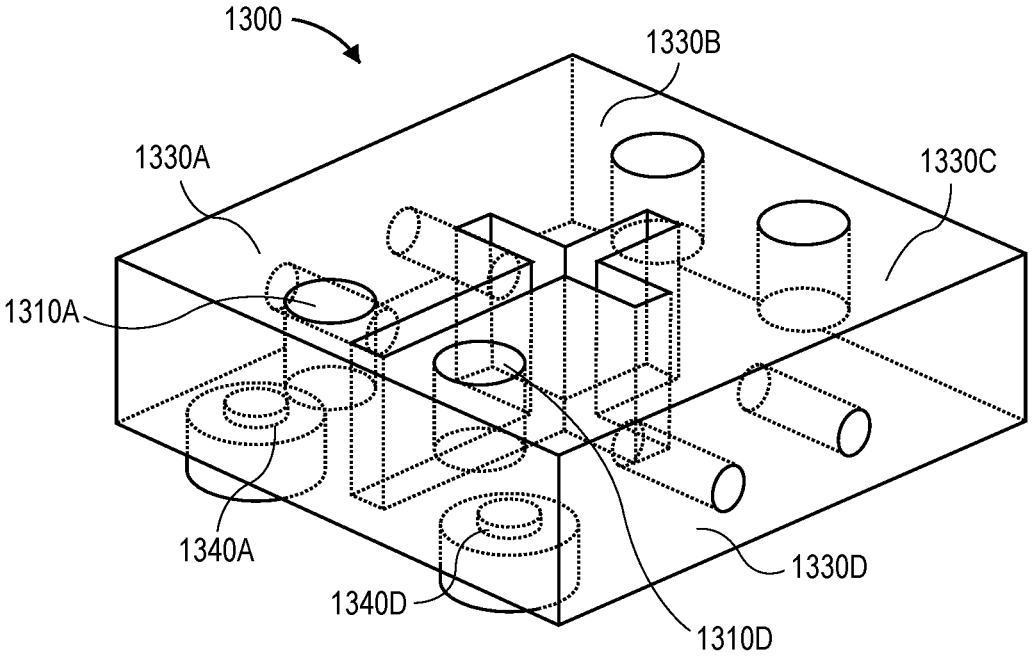
FIG. 13A is an isometric view of an 8-pole filter with partial-height input/output probes coupled with ridge waveguides in accordance with an embodiment.
Figure 13B:
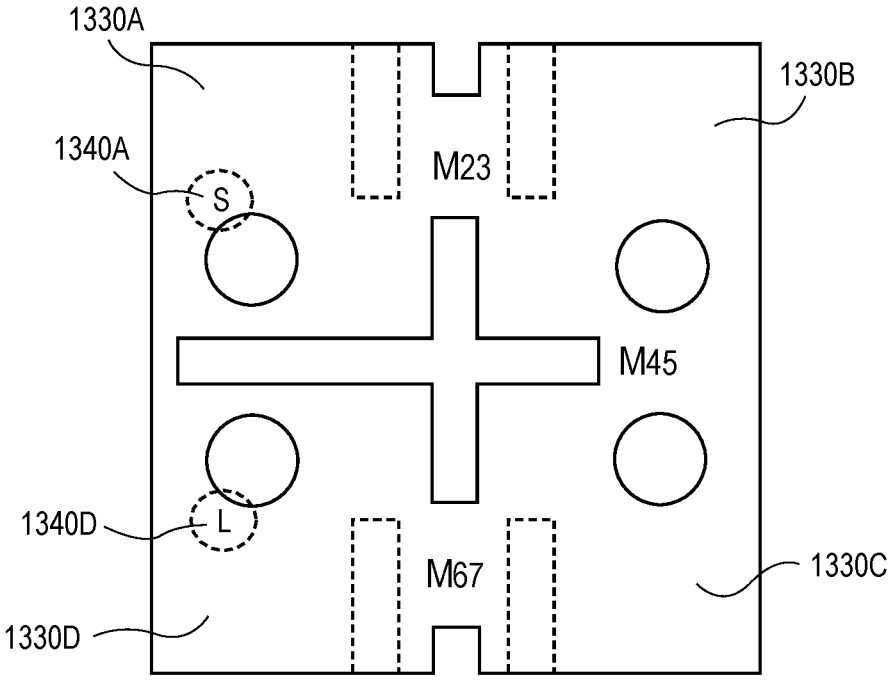
FIG. 13B is a top down view of the filter of FIG. 13A.

FIGS. 13A-13B illustrate an 8-pole filter 1300 formed by four dual-mode resonator pairs, 1330A, 1330B, 1330C, and 1330D. Each of the metalized cylindrical resonators is a quarter-wavelength (¼λ) long resonator with one end short-circuited on a conductive side wall of the dual-mode resonator. That is, the metal cylinder is about quarter of a wavelength long in terms of the center frequency of the filter in the dielectric. One of its ends is terminated on the side conductive wall of the dielectric block, and the other end is free from any electric contact to the walls of the cavity, forming an open circuit. The diameter of the metal cylinder is electrically small, for example less than 0.1 wavelength. The ridge waveguide resonator supports a $TE_{101}$ like mode whereas the cylindrical resonator supports a TEM mode. Two of which form a dual-mode resonator, and each of which forms a distinct electric resonator.

Coaxial input/output probes 1340A and 1340D are formed on the bottom of the dielectric block, opposite the openings to the ridge waveguide resonators. They are partially inserted into the first and last ridge waveguide resonators with ridges 1310A and 1310D, respectively, to create input/output coupling.

Figure 14:
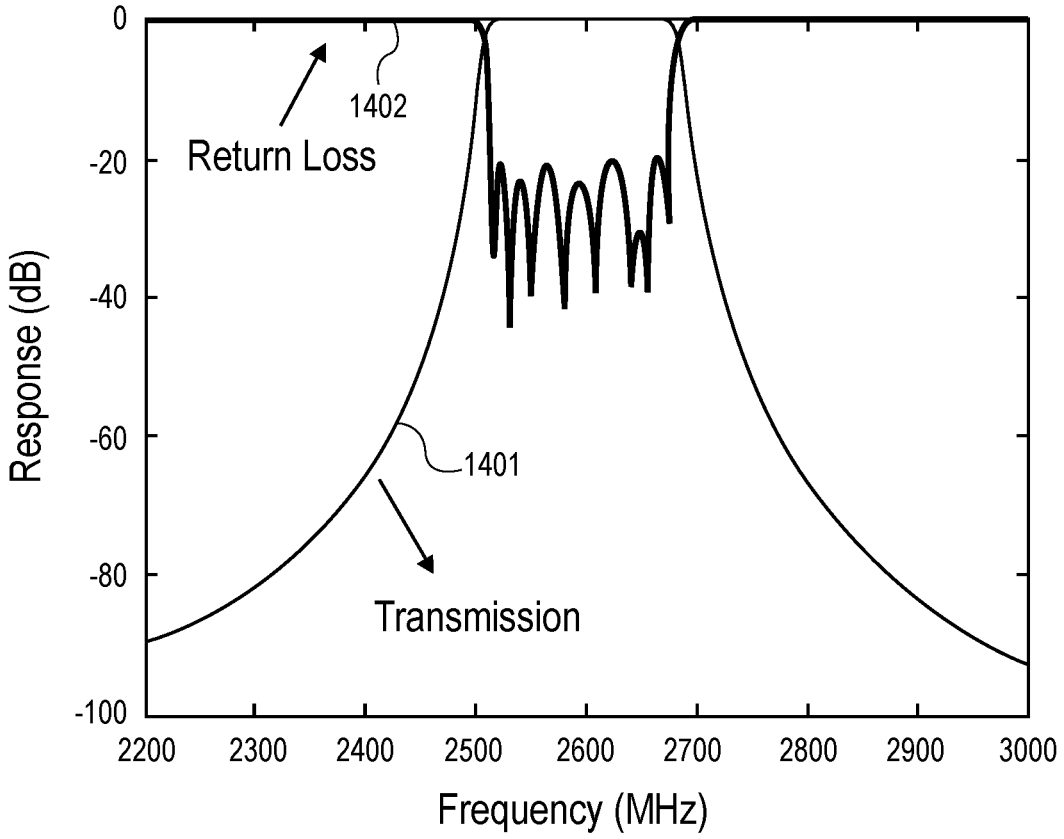
FIG. 14 is a frequency response chart produced from an electromagnetic simulation of the filter of FIG. 13A.

FIG. 14 shows a typical transmission response of the 8-pole filter of FIG. 13A. Transmission coefficient 1401 is well defined. Return loss 1402 is better than −20 dB in the passband.

Figure 15A:
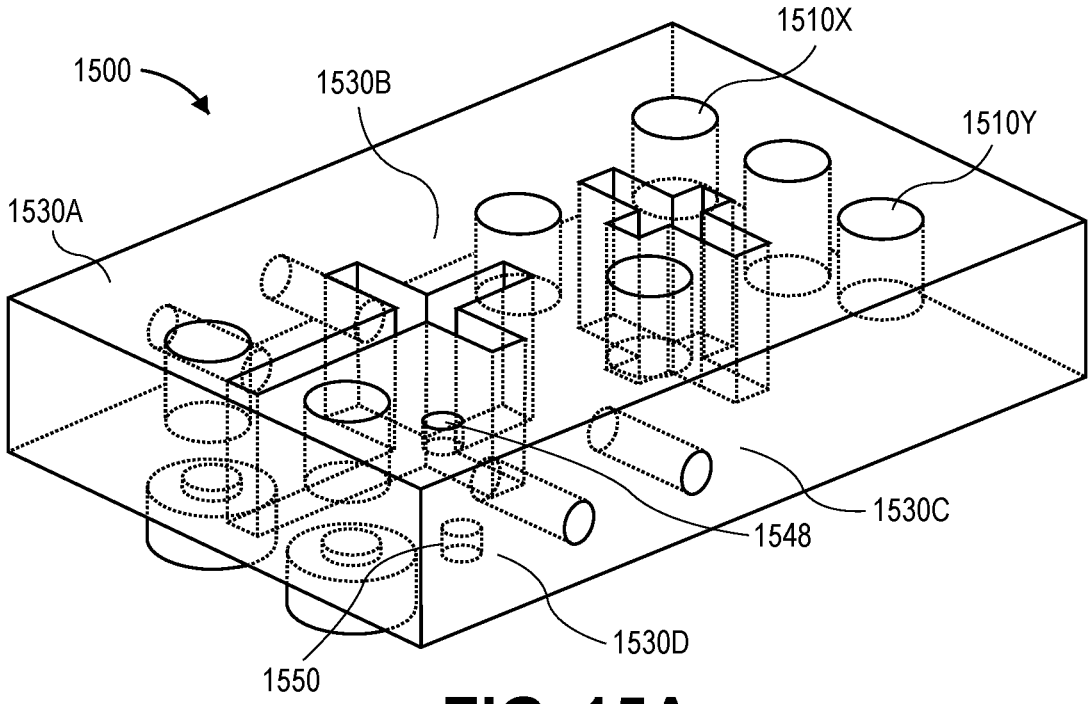
FIG. 15A is an isometric view of a 10-pole filter, comprising four dual-mode resonator pairs and two single-mode ridge waveguide resonators in accordance with an embodiment.
Figure 15B:
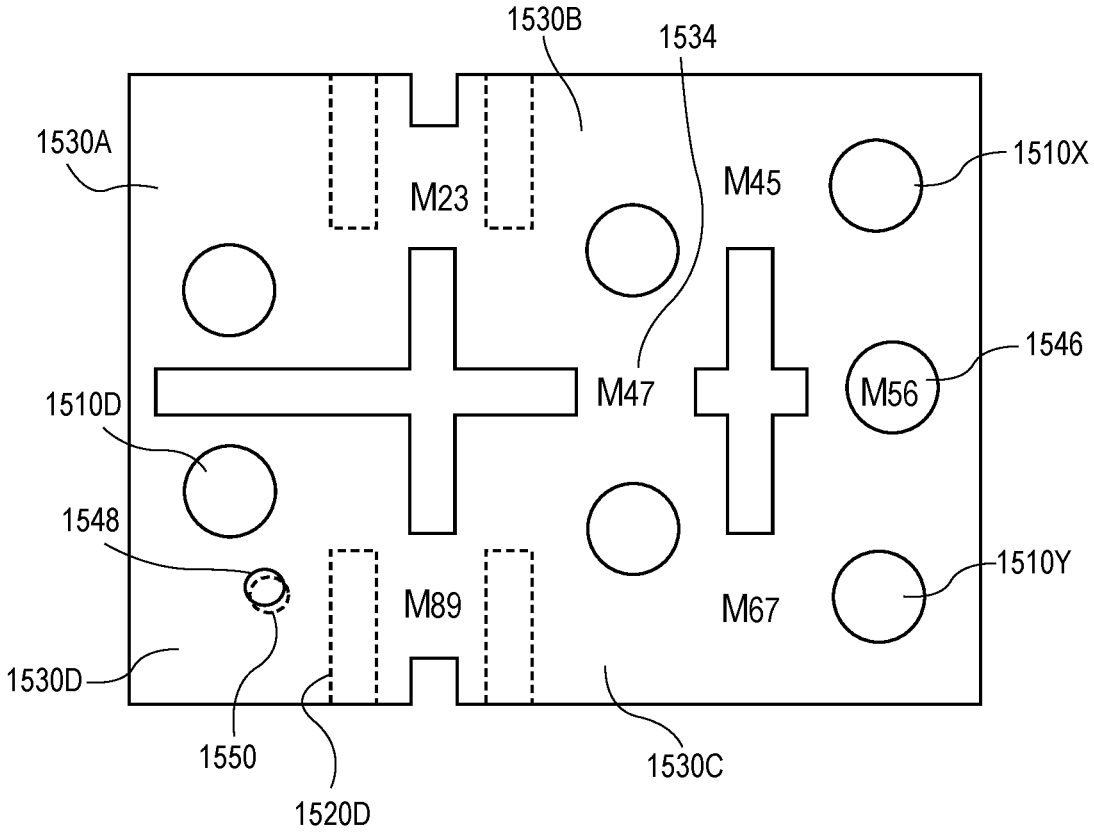
FIG. 15B is a top down view of the filter of FIG. 15A.

FIGS. 15A-15B illustrate a 10-pole filter 1500 formed by four dual-mode waveguide cavity resonator pairs, 1530A, 1530B, 1530C, and 1530D, and two single-mode ridge waveguide resonators 1510X and 1510Y. Each of the metalized cylindrical coaxial resonators is a quarter-wavelength long resonator with one end short-circuited on a conductive side wall of the dual-mode resonator.

Blind hole 1546 is formed along the vertical direction on the top surface of the dielectric block between resonators 1510X and 1510Y for creating an opposite coupling as compared to the coupling with partial-width coupling window 1534 between the two ridge waveguide resonators.

The blind hole structures for creating opposite coupling were published by Rosenberg and Amari in 2007 (U. Rosenberg and S. Amari, "A novel band-reject element for pseudo elliptic bandstop filters," IEEE Transactions on Microwave Theory and Techniques, vol. 55, pp. 742-746, Apr. 2007), including a partial-height conducting post that was proposed for creating transmission zeros, termed a "band-reject element."

Bottom blind hole 1550, a partial height vertical metal cylinder, controls the coupling between the TEM mode and the $TE_{101}$ like mode in the same dual-mode resonator, i.e., the coupling between ridge waveguide resonator 1510D and quarter-wavelength cylindrical blind hole 1520D. Bottom blind hole 1550 is introduced along the vertical direction on the bottom surface of the cavity to reduce the coupling.

Top blind hole 1548, a partial height vertical cylinder formed along the vertical direction on the top surface of the dielectric block, increases the coupling between the TEM mode and the $TE_{101}$ like mode in the same dual-mode resonator.

When the blind hole is inserted along the vertical direction from the bottom surface of the dielectric block, the coupling is reduced. Whereas when the blind hole is formed along the vertical direction from the top surface of the dielectric block, the coupling is increased.

Figure 16:
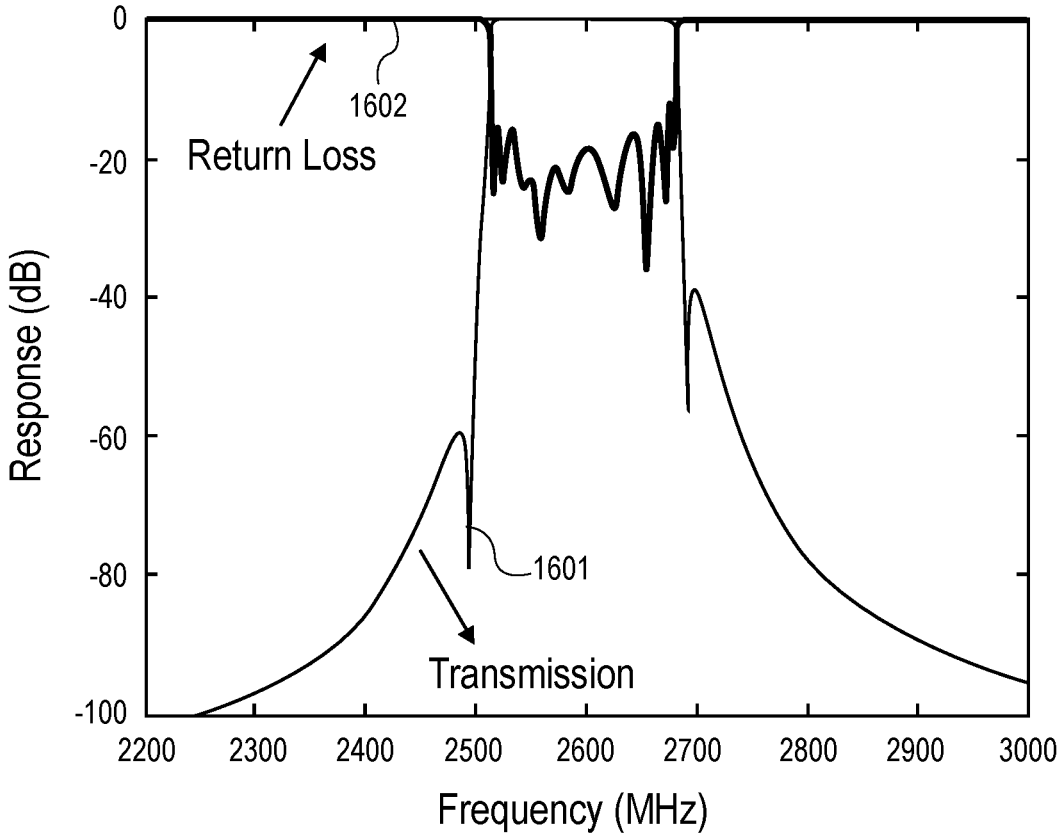
FIG. 16 is a frequency response plot produced from an electromagnetic simulation of the filter of FIG. 15A.

FIG. 16 shows electromagnetic simulated transmission and reflection responses of the 10-pole filter of FIG. 15A. Transmission coefficient 1601 has two transmission zeros, one on each side of the pass band. They are a result of a cascaded quartet (CQ) unit together with the partial-width coupling window. Reflection coefficient 1602 is around −20 dB in the passband.

Figure 17A:
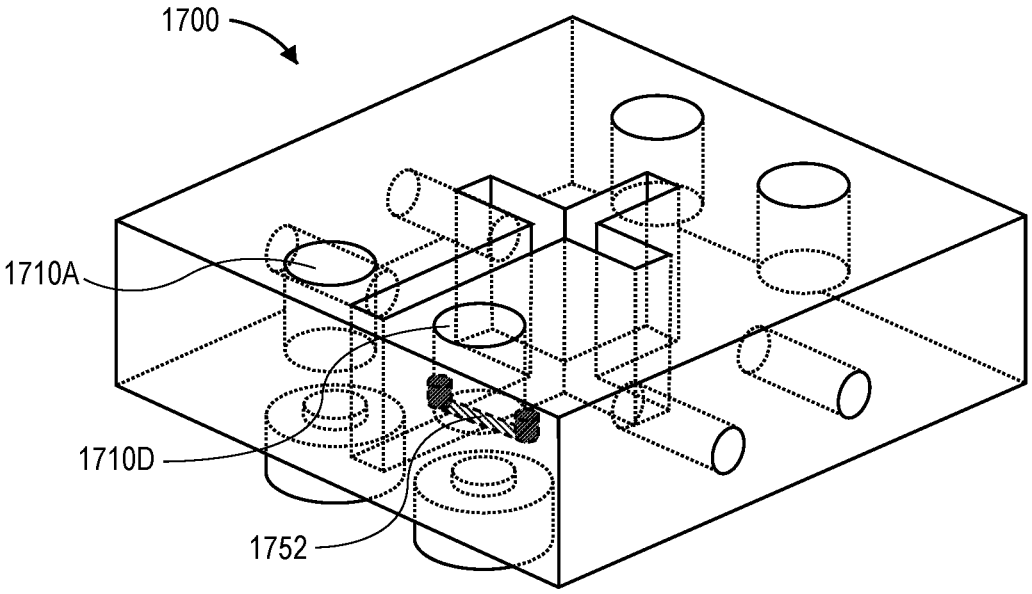
FIG. 17A is an isometric view of an 8-pole filter with a microstrip coupling structure in accordance with an embodiment.
Figure 17B:
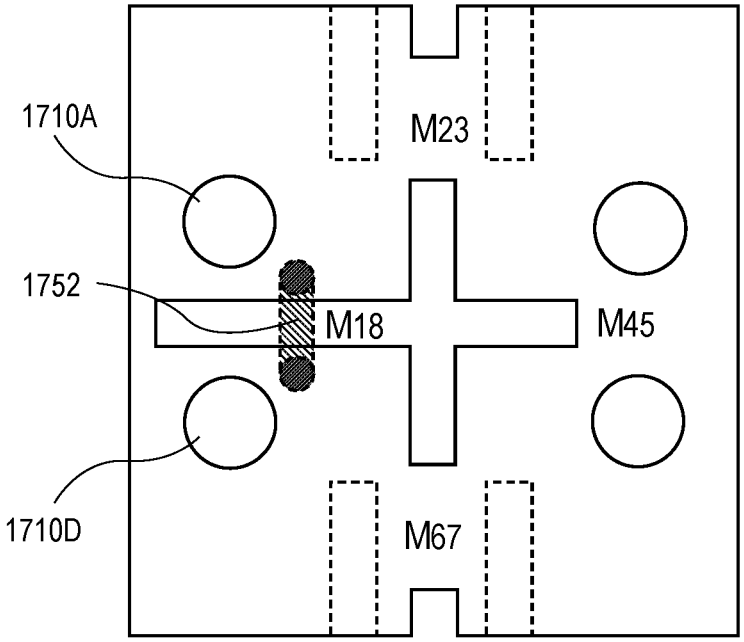
FIG. 17B is a top down view of the filter of FIG. 17A.
Figure 17C:
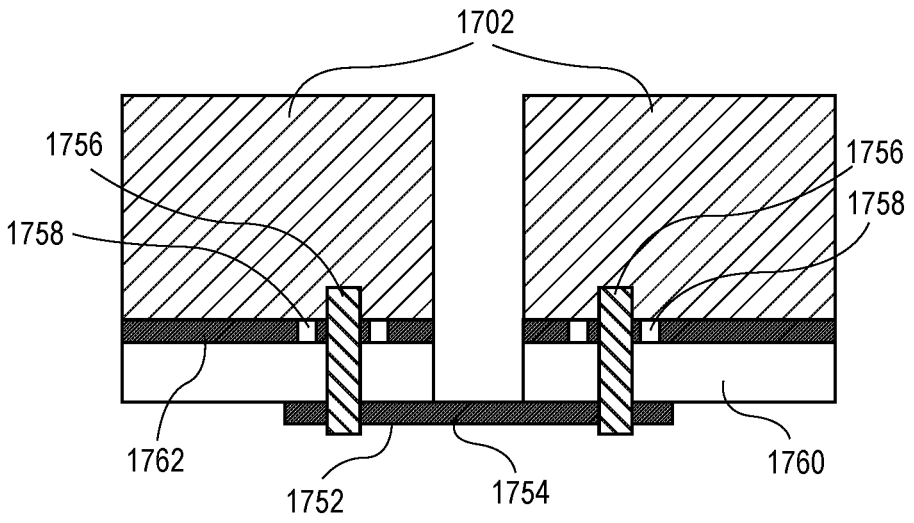
FIG. 17C is a cross-section of the filter of FIG. 17A.

FIGS. 17A-17C illustrate an 8-pole filter 1700 formed by four dual-mode resonator pairs. Each of the metalized cylindrical coaxial resonators is a quarter-wavelength (¼λ) long resonator with one end short-circuited on a conductive side wall of the dual-mode resonator.

Coupling structure 1752 is set between nonadjacent resonators 1710A and 1710D in dielectric block 1702. The coupling structure electrically couples the two resonators, producing transmission zeros on both sides of the pass band. Coupling structure 1752 includes conductive microstrip 1754 and a pair of metallic partial height probes 1756. The amount of coupling can be controlled by adjusting the length and the width of the microstrip.

Probes 1756 are connected by solder pads 1758 to ground layer 1762. Ground layer 1762 is supported by substrate layer 1760.

Figure 18:
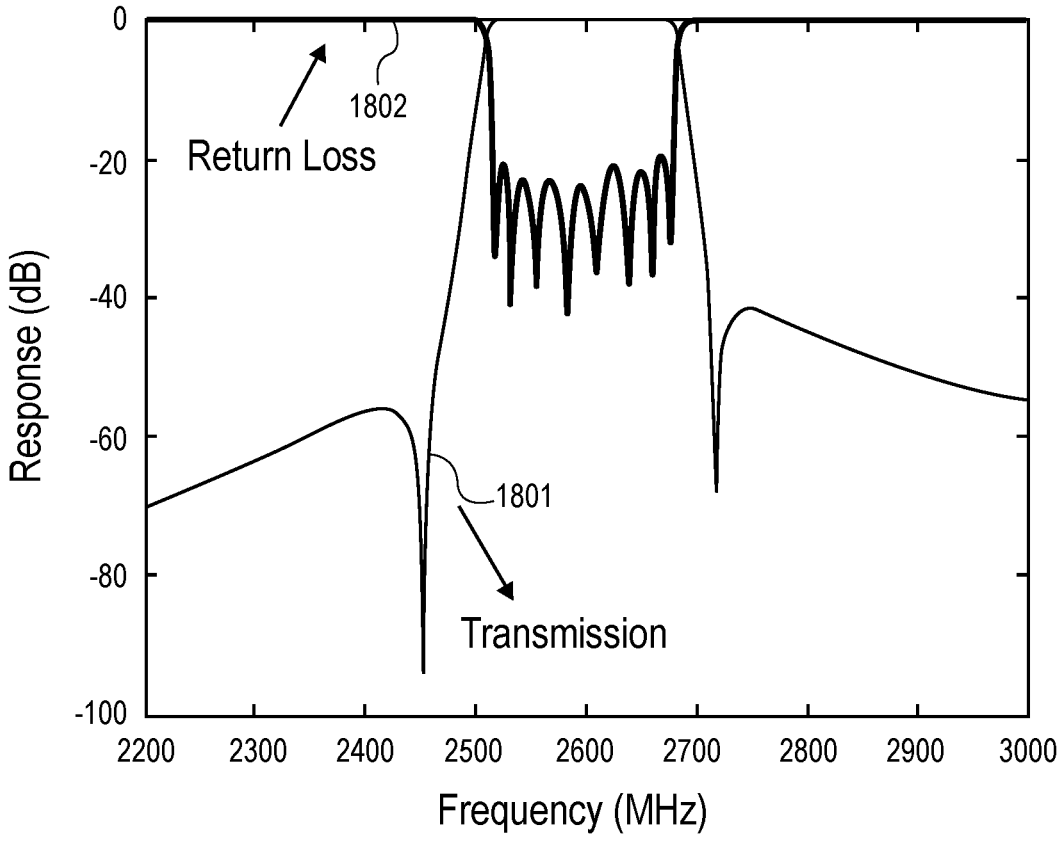
FIG. 18 is a frequency response plot produced from a simulation of the filter of FIG. 17A.

FIG. 18 shows a electromagnetic simulated transmission and reflection responses of the 8-pole filter of FIG. 17A. Transmission coefficient 1801 has two transmission zeros, one on each side of the pass band, caused by the coupling structure. Reflection coefficient 1802 is better than −20 dB in the pass band.

Figure 19:
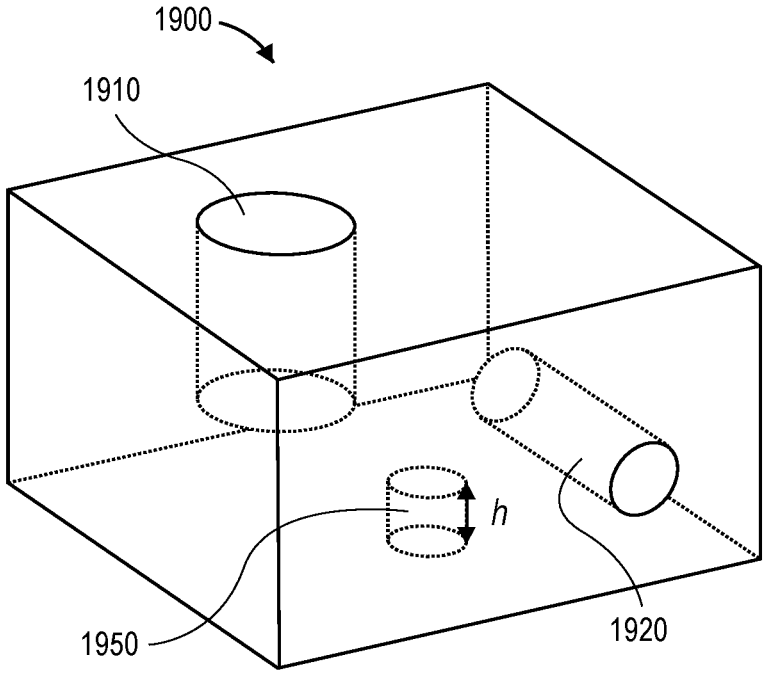
FIG. 19 is an isometric view of a dual-mode resonator pair with a coupling control post in accordance with an embodiment.

FIG. 19 is an isometric view of a dual-mode resonator pair with a coupling control post in accordance. In dual-mode resonator 1900, right cylindrical depression 1910 couples with horizontal cylindrical cavity 1920.

Coupling control post 1950 extends vertically from the bottom of the dielectric block and sits between right cylindrical depression 1910 and horizontal cylindrical cavity 1920 in a planform view. That is, looking downward at the dielectric block from the top to the bottom, coupling control post 1950 would appear to be between right cylindrical depression 1910 and horizontal cylindrical cavity 1920. The coupling control post can be a hollow blind hole with a metalized surface, a solid metal filled blind hole, or a similar structure.

A height (or depth) 'h' of the coupling control post dictates the coupling between right cylindrical depression 1910 and horizontal cylindrical cavity 1920. It can be found that when the coupling control post is inserted along the vertical direction from the bottom surface of the dielectric block, the coupling is reduced. Meanwhile, when the coupling control post is formed along the vertical direction from the top surface of the dielectric block, the coupling is increased. Thus, a coupling control post extending from the top surface (see 1548 of FIG. 15A), can be used as another design dimension.

Figure 20:
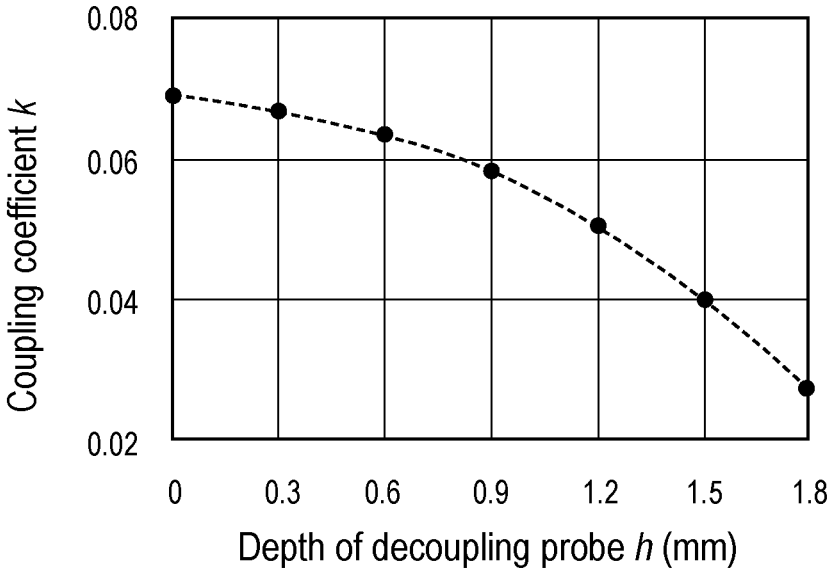
FIG. 20 is a chart of plotting simulated coupling coefficient versus a depth of the coupling control post in FIG. 19.

FIG. 20 is a chart plotting simulated coupling coefficient versus a depth of the coupling control post in FIG. 19. Designing with a specific height/depth of the coupling control post inserted from the bottom of the block can produce a particular coupling coefficient.

Although specific embodiments of the invention have been described, various modifications, alterations, alternative constructions, and equivalents are also encompassed within the scope of the invention. Embodiments of the present invention are not restricted to operation within certain specific environments, but are free to operate within a plurality of environments. Additionally, although method embodiments of the present invention have been described using a particular series of and steps, it should be apparent to those skilled in the art that the scope of the present invention is not limited to the described series of transactions and steps.

Further, while embodiments of the present invention have been described using a particular combination of hardware, it should be recognized that other combinations of hardware are also within the scope of the present invention.

The specification and drawings are, accordingly, to be regarded in an illustrative rather than a restrictive sense. It will, however, be evident that additions, subtractions, deletions, and other modifications and changes may be made thereunto without departing from the broader spirit and scope.

What is claimed is:

1. A dielectric resonator filter apparatus comprising:

a dielectric block having a top and sides;

a right cylindrical depression in the top of the dielectric block;

a horizontal cylindrical cavity within the dielectric block, the horizontal cylindrical cavity having an axis that is parallel with the top of the dielectric block;

a conductive layer covering the dielectric block, the right cylindrical depression, and an inside surface of the horizontal cylindrical cavity, whereby the right cylindrical depression is a ridge waveguide resonator that is dominated by a transverse electric ($TE_{101}$) like mode, and the horizontal cylindrical cavity is configured to support a transverse electromagnetic (TEM) mode of electromagnetic waves within operating wavelengths of the dielectric resonator filter apparatus, the right cylindrical depression configured to affect electromagnetic coupling between the $TE_{101}$ like mode and the TEM mode.

2. The apparatus of claim 1 wherein a length of the horizontal cylindrical cavity is about one quarter of the operating wavelengths.

3. The apparatus of claim 1 further comprising:

a coupling control post extending between the right cylindrical depression and the horizontal cylindrical cavity from the top or a bottom of the dielectric block, the coupling control post including a blind hole with metalized surfaces or a solid metal cylinder.

4. The apparatus of claim 1 further comprising:

an opening from an outside of the dielectric block to the horizontal cylindrical cavity.

5. The apparatus of claim 4 wherein the horizontal cylindrical cavity extends to one of the sides of the dielectric block and forms the opening.

6. The apparatus of claim 1 further comprising:

a coaxial feeding probe extending from underneath the dielectric block, the coaxial feeding probe closer to the right cylindrical depression than the horizontal cylindrical cavity.

7. The apparatus of claim 1 wherein the right cylindrical depression and the horizontal cylindrical cavity constitute a first dual-mode resonator pair, the right cylindrical depression being a first right cylindrical depression, and the horizontal cylindrical cavity being a first horizontal cylindrical cavity, the apparatus further comprising:

a second dual-mode resonator pair in the dielectric block comprising a second right cylindrical depression in the top of the dielectric block and a second horizontal cylindrical cavity within the dielectric block; and a partial-width dielectric window between the first and second dual-mode resonator pairs, the partial-width dielectric window formed by a conductive, vertical channel in one or more of the sides of the dielectric block.

8. The apparatus of claim 7 wherein axes of the first and second cylindrical cavities are parallel, and the first and second cylindrical cavities extend from a common side of the dielectric block.

9. The apparatus of claim 8 wherein the first or second right cylindrical depression is between the first and second cylindrical cavities.

10. The apparatus of claim 7 wherein axes of the first and second cylindrical cavities are parallel, and the first and second cylindrical cavities extend from opposite sides of the dielectric block.

11. The apparatus of claim 7 wherein axes of the first and second cylindrical cavities are perpendicular to one another.

12. The apparatus of claim 7 wherein the first and second cylindrical cavities share a common axis, and the first and second cylindrical cavities extend from opposite sides of the dielectric block.

13. The apparatus of claim 12 wherein the conductive, vertical channel bisects the common axis between the first and second cylindrical cavities.

14. The apparatus of claim 7 further comprising:

a third dual-mode resonator pair in the dielectric block comprising a third right cylindrical depression and a third horizontal cylindrical cavity;

a fourth dual-mode resonator pair in the dielectric block comprising a fourth right cylindrical depression and a fourth horizontal cylindrical cavity; and partial-width dielectric windows between multiple of the dual-mode resonator pairs, each partial-width dielectric window formed by a conductive, vertical channel in one or more of the sides of the dielectric block, wherein axes of the first and second cylindrical cavities are perpendicular, axes of the second and third cylindrical cavities are parallel, and axes of the third and fourth cylindrical cavities are perpendicular, whereby the first, second, third, and fourth dual-mode resonator pairs form an 8-pole dielectric resonator filter.

15. The apparatus of claim 7 further comprising:

a third dual-mode resonator pair in the dielectric block comprising a third right cylindrical depression and a third horizontal cylindrical cavity;

a fourth dual-mode resonator pair in the dielectric block comprising a fourth right cylindrical depression and a fourth horizontal cylindrical cavity;

a fifth right cylindrical depression in the dielectric block;

a sixth right cylindrical depression in the dielectric block;

partial-width dielectric windows between multiple of the dual-mode resonator pairs, each partial-width dielectric window being formed by a conductive, vertical channel in one or more of the sides of the dielectric block; and partial-width dielectric windows between the dual-mode resonator pairs and the fifth and sixth right cylindrical depressions, wherein axes of the first, second, third, and fourth cylindrical cavities are parallel, whereby the first, second, third, and fourth resonator pairs and fifth and sixth right cylindrical depressions form a 10-pole dielectric resonator filter.

16. The apparatus of claim 15 further comprising:

a coupling control post extending between the right cylindrical depression and the horizontal cylindrical cavity of at least one of the first, second, third, or fourth dual-mode resonator pairs from the top or a bottom of the dielectric block, the coupling control post including a blind hole with metalized surfaces or a solid metal cylinder.

17. The apparatus of claim 15 further comprising:

a metalized blind hole extending between the fifth and sixth right cylindrical depressions for creating an opposite coupling as compared to that created by a partial-width dielectric window between the fifth and sixth right cylindrical depressions.

18. The apparatus of claim 7 further comprising:

a third dual-mode resonator pair in the dielectric block comprising a third right cylindrical depression and a third horizontal cylindrical cavity;

a fourth dual-mode resonator pair in the dielectric block comprising a fourth right cylindrical depression and a fourth horizontal cylindrical cavity;

partial-width dielectric windows between multiple of the dual-mode resonator pairs, each partial-width dielectric window being formed by a conductive, vertical channel in one or more of the sides of the dielectric block; and a conductive strip extending between dual-mode resonator pairs between which there exists no partial-width or full-width dielectric window.

19. The apparatus of claim 1 wherein the right cylindrical depression has a cross section of a circle, a rectangle, or a square.

20. The apparatus of claim 19 wherein the cross section is rectangular or square and has filleted or chamfered corners.

21. The apparatus of claim 1 wherein the dielectric block is rectangular.

22. The apparatus of claim 1 wherein the dielectric block comprises a material selected from the group consisting of ceramic, glass, or a polymer.

23. A transceiver comprising the dielectric resonator filter apparatus of claim 1.

24. A base station comprising the transceiver of claim 23.

* * * * *